US010402919B2

(12) United States Patent
Farah et al.

(10) Patent No.: US 10,402,919 B2
(45) Date of Patent: Sep. 3, 2019

(54) DATA ASSIMILATION FOR CALCULATING COMPUTER-BASED MODELS OF CROP GROWTH

(71) Applicant: The Climate Corporation, San Francisco, CA (US)

(72) Inventors: Marian Farah, San Francisco, CA (US); Jeffrey Gerard, Seattle, WA (US)

(73) Assignee: The Climate Corporation, San Francisco, CA (US)

( * ) Notice: Subject to any disclaimer, the term of this patent is extended or adjusted under 35 U.S.C. 154(b) by 294 days.

(21) Appl. No.: 15/348,749

(22) Filed: Nov. 10, 2016

(65) Prior Publication Data

US 2017/0351790 A1 Dec. 7, 2017

Related U.S. Application Data

(60) Provisional application No. 62/346,004, filed on Jun. 6, 2016.

(51) Int. Cl.
*G06Q 50/02* (2012.01)

(52) U.S. Cl.
CPC ..... *G06Q 50/02* (2013.01)

(58) Field of Classification Search
CPC ..... A01G 22/10; G06Q 50/02; G06F 17/50; G06F 17/10
See application file for complete search history.

(56) References Cited

U.S. PATENT DOCUMENTS 6,662,185 B1 * 12/2003 Stark ..... A01G 7/00
2004/0249738 A1 * 12/2004 Mathews ..... G06Q 10/06 705/36 R
2016/0224703 A1 * 8/2016 Shriver ..... G06F 17/5009

OTHER PUBLICATIONS

David F. Bradford, Harry H. Kelejian; The Value of Information for Crop Forecasting in a Market System: Some Theoretical Issues, The Review of Economic Studies, vol. 44, Issue 3, Oct. 1, 1977, pp. 519-531, https://doi.org/10.2307/2296905 (Year: 1977).*

(Continued)

*Primary Examiner* — Saif A Alhija
*Assistant Examiner* — David A Hopkins
(74) *Attorney, Agent, or Firm* — Hickman Palermo Becker Bingham LLP

(57) ABSTRACT

A method for estimating growth stage threshold values for a specific hybrid seed at a specific geo-location using historical growth stage data and observed growth stage data comprises using a server computer system, storing a historical crop growth model of one or more hybrid seeds measured from one or more fields over a particular period of time. The historical crop growth model includes growth stage threshold estimates for one or more hybrid seeds. The server computer system receives, via a network, one or more digital measurement values specifying one or more observed growth stage values for a particular hybrid seed at a particular field over a particular period of time. The server computer system transforms the growth stage thresholds into growth stage duration values for the historical crop data and the observed crop data. The server computer system then generates a posterior distribution of growth stage duration values for the particular hybrid seed using a multivariate distribution of growth stage duration value data, which is comprised of historical and observed growth stage data, a covariate matrix describing correlations between different growth stages, and an error matrix used to represent variations in the multivariate distribution. The server computer system estimates mean duration values and variance values for the different growth stages for the particular hybrid seed and then calculates estimated crop growth threshold values for the particular hybrid seed. The server computer system then sends the estimated crop growth threshold values to one or more external computer systems for the purposes of updating and programming crop management instructions.

24 Claims, 10 Drawing Sheets

(56) References Cited

OTHER PUBLICATIONS

Panda, Sudhanshu Sekhar, Daniel P. Ames, and Suranjan Panigrahi. "Application of vegetation indices for agricultural crop yield prediction using neural network techniques." Remote Sensing 2.3 (2010): 673-696. (Year: 2010).*

Sexton, David MH, et al. "Multivariate probabilistic projections using imperfect climate models part I: outline of methodology." Climate dynamics 38.11-12 (2012): 2513-2542. (Year: 2012).*

* cited by examiner (a)

(b)

810 GDD thresholds derived on the Celsius scale for RM 112

| Stage | V2 | V4 | V6 | V8 | V10 | V12 | V14 | V16 | R1 | R2 | R3 | R4 | R5 | R5.5 | R6 |
|---|---|---|---|---|---|---|---|---|---|---|---|---|---|---|---|
| GDD | 177 | 306 | 421 | 540 | 655 | 771 | 886 | 1005 | 1240 | 1526 | 1818 | 2120 | 2281 | 2499 | 2700 |

FIG. 10

1005

$$\Lambda_1 = \overbrace{\begin{pmatrix} 1 & \lambda_1 & & & & \\ \lambda_1 & 1 & \lambda_1 & & \mathbf{0} & \\ & \lambda_1 & \ddots & \ddots & & \\ & & \ddots & \ddots & \lambda_1 & \\ \mathbf{0} & & & \lambda_1 & 1 & \lambda_1 \\ & & & & \lambda_1 & 1 \end{pmatrix}}^{\text{v_columns}} \Bigg\} \text{v_rows}$$

1010

$$\Lambda_2 = \overbrace{\begin{pmatrix} 1 & \lambda_2 & & & & \\ \lambda_2 & 1 & \lambda_2 & & \mathbf{0} & \\ & \lambda_2 & \ddots & \ddots & & \\ & & \ddots & \ddots & \lambda_2 & \\ \mathbf{0} & & & \lambda_2 & 1 & \lambda_2 \\ & & & & \lambda_2 & 1 \end{pmatrix}}^{\text{r_columns}} \Bigg\} \text{r_rows}$$

1015

$$\Lambda_{12} = \overbrace{\begin{pmatrix} 0 & 0 & 0 & 0 & 0 \\ \vdots & \vdots & \vdots & \vdots & \vdots \\ \vdots & \vdots & \vdots & \vdots & \vdots \\ 0 & 0 & 0 & 0 & 0 \\ \lambda_3 & \lambda_4 & \lambda_4 & \lambda_4 & \lambda_4 \end{pmatrix}}^{\text{cross_r_columns}} \Bigg\} \text{cross_v_rows}$$

DATA ASSIMILATION FOR CALCULATING COMPUTER-BASED MODELS OF CROP GROWTH

BENEFIT CLAIM

This application claims the benefit of provisional application 62/346,004, filed Jun. 6, 2016, the entire contents of which is hereby incorporated by reference as if fully set forth herein, under 35 U.S.C. § 119(e).

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright or rights whatsoever. © 2015 The Climate Corporation.

FIELD OF THE DISCLOSURE

The present disclosure relates to computer-implemented techniques for combining observed agricultural crop phenology data with a computer-implemented data model or algorithm that represents growth of corn or other crops.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

Successfully harvesting corn grain depends on many managerial factors including hybrid selection, soil fertilization, irrigation, and pest control which each contribute to the growth rate of corn plants. These factors must be accounted for when determining the optimal time to harvest the corn grain. Harvesting times relative to the corn maturity is especially important because water content of corn grain, when harvested, affects the sales price of the bushel of corn harvested. Grain moisture is used to determine a sales price per bushel of a particular grade of corn. Grain moisture refers to and is measured as the ratio of water mass to wet kernel mass. The grain moisture level is important to buyers because the level of moisture in grain can affect the amount of degradation of grain during storage and shipment. If a grower harvested corn that has higher than desired grain moisture, then buyers may demand a discount for the harvested corn. The loss or cost may be significant.

As the corn plant grows, it progresses through multiple growth stages of development. These stages are identified by physical traits of the corn plant. Stages include multiple vegetative stages that track growth of the corn plant leaves and reproductive stages that track development of the corn kernels. During the vegetative and reproductive stages the corn plant transfers water and nutrients collected by the corn plant to the kernels. During maturation the amount of kernel moisture begins to slowly decrease. When the kernel reaches physiological maturity, referred to as R6 stage, there is a passive exchange of moisture between the kernel and outside air. The R6 stage is also referred to as "black layer" because physiological maturity occurs when a black layer forms at the base of the kernels. The black layer is a hard starch layer that turns black or brown and cuts off the water and dry matter transfer to the kernel. Once the R6 stage is reached the decrease in kernel moisture is primarily due to the rate of water loss from the kernel itself to outside air. This rate is referred to as grain dry down.

Reaching the R6 layer and the subsequent grain dry down are influenced by many factors, including the ambient air temperature and humidity and absorption of water and nutrients by the corn plant during the vegetative and reproductive phases. Watering strategies and the amount of nutrients in the soil may affect the overall starting grain moisture at R6. Therefore understanding and tracking the multiple vegetative and reproductive stages during corn plant growth are desirable for planning when to apply nutrients, such as nitrogen to the soil, and when to deliver water based on the corn growth stage.

Historically harvest times, based upon the predicted R6 date, may be modeled using the weather, hybrid seed type, and historical data. Since R6 begins when the physical black layer at the base of the kernel starts, visual observation is not possible unless the corn is dissected; therefore growers estimate the beginning of the R6 stage using models that approximate R6 based on data provided by hybrid seed producers and observed temperature data from previous harvests of the hybrid seeds. However, approximating the start of R6 based solely upon historical data does not take into account specific variances of the corn plant based upon direct physical observations of the planted corn. Individual fluctuations between grain moisture content at R6 for specific hybrid seed varieties may lead to errors when predicting harvest times based upon a target grain moisture content at harvest.

SUMMARY

The appended claims may serve as a summary of the disclosure.

BRIEF DESCRIPTION OF THE DRAWINGS

In the drawings:

FIG. 10 depicts example embodiments of parameter matrices showing correlations between neighboring growth stages.

DETAILED DESCRIPTION

Figure 1:
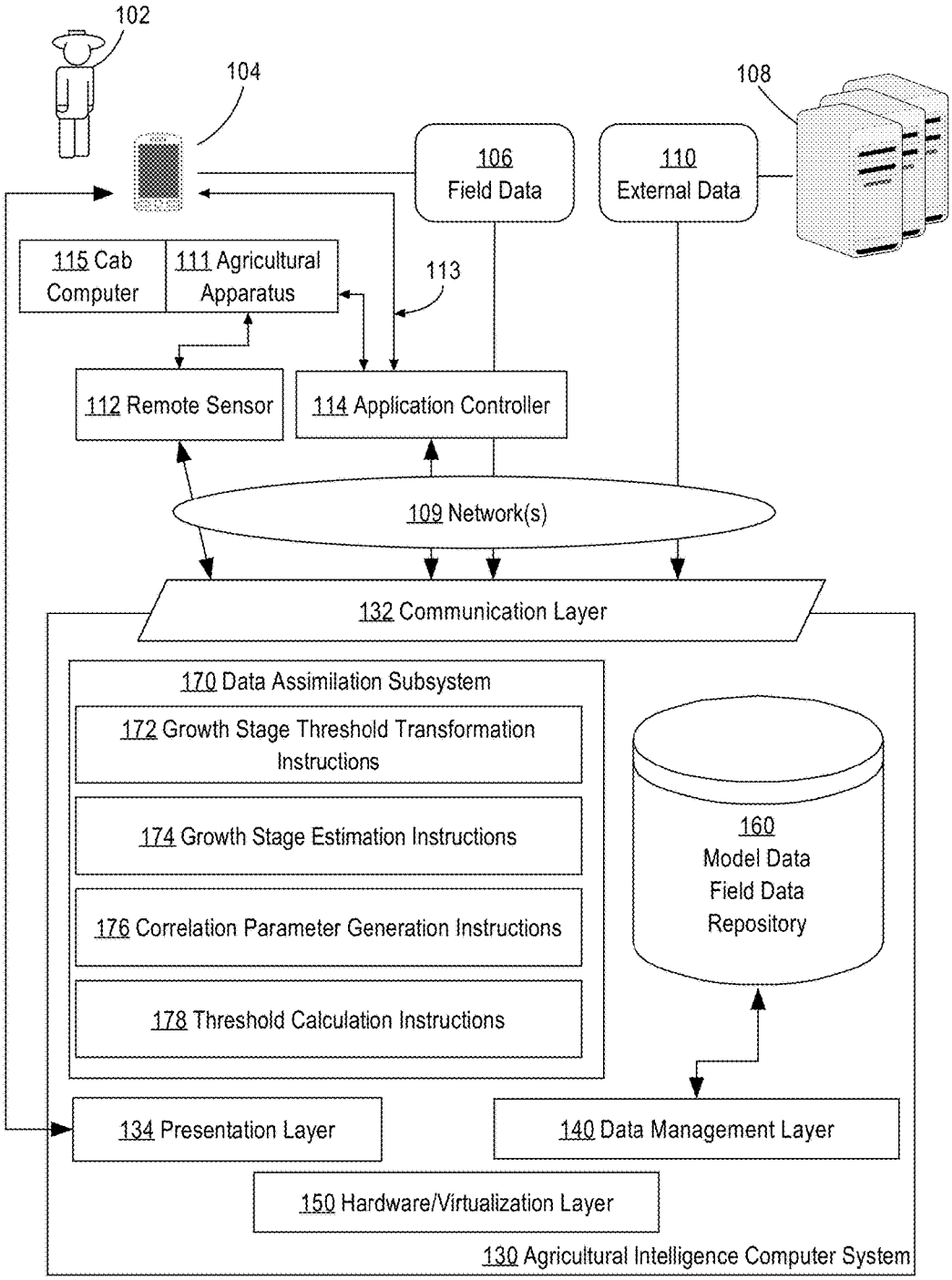
FIG. 1 illustrates an example computer system that is configured to perform the functions described herein, shown in a field environment with other apparatus with which the system may interoperate.

In the following description, for the purposes of explanation, numerous specific details are set forth in order to provide a thorough understanding of the present disclosure. It will be apparent, however, that embodiments may be practiced without these specific details. In other instances, well-known structures and devices are shown in block diagram form in order to avoid unnecessarily obscuring the present disclosure. Embodiments are disclosed in sections according to the following outline:

1. GENERAL OVERVIEW
2. EXAMPLE AGRICULTURAL INTELLIGENCE COMPUTER SYSTEM
2.1. STRUCTURAL OVERVIEW
2.2. APPLICATION PROGRAM OVERVIEW
2.3. DATA INGEST TO THE COMPUTER SYSTEM
2.4. PROCESS OVERVIEW—AGRONOMIC MODEL TRAINING
2.5. DATA ASSIMILATION SUBSYSTEM
2.6. IMPLEMENTATION EXAMPLE—HARDWARE OVERVIEW
3. FUNCTIONAL OVERVIEW
3.1. DATA INPUT
3.1.1. STORING HISTORICAL DATA MODEL
3.1.2. RECEIVING OBSERVATION DATA
3.2. ASSIMILATED CROP DATA MODEL
3.2.1. TRANSFORMING GROWTH STAGE THRESHOLD DATA
3.2.2. GENERATING ASSIMILATED CROP DATA MODEL
3.2.2.1. A COMPLETE SET OF OBSERVED GROWTH STAGES
3.2.2.2. AN INCOMPLETE SET OF OBSERVED GROWTH STAGES
3.3. ESTIMATING THRESHOLDS FOR TARGET FIELD
3.4. COMMUNICATING ESTIMATED GROWTH STAGE THRESHOLDS
4. CONFIGURING CORRELATION PARAMETERS
5. CROP PHENOLOGY
6. EXTENSIONS AND ALTERNATIVES

1. General Overview

A computer system and a computer-implemented method that are configured to estimate growth stage threshold values for a specific hybrid seed at a specific geo-location using historical growth stage data and observed growth stage data is provided. In an embodiment, estimating growth stage threshold values may be accomplished using a server computer system that is configured and programmed to store, in digital memory, a historical crop growth model of one or more hybrid seeds measured from one or more fields over a particular period of time. The historical crop growth model may contain a plurality of values and expressions that define transformations of and relationships between different values and are used to produce one or more sets of historical growth stage threshold estimates for the one or more hybrid seeds measured. The one or more sets of historical growth stage threshold estimates may define boundaries between phenology growth stages of hybrid seeds.

The server computer system is configured and programmed to receive, over one or more networks from a remote computing device, one or more digital measurement values specifying one or more observed growth stage values for a particular hybrid seed at a particular field over a particular period of time. The server computer system is configured and programmed to transform the growth stage threshold values from the historical growth stage duration values and the observed growth stage duration values into growth stage duration values, producing one or more sets of historic growth stage duration values and one or more observed growth stage duration values.

The server computer system is configured and programmed to generate a posterior distribution of growth stage duration values for the particular hybrid seed using a multivariate distribution of growth stage duration value data. The multivariate distribution of growth stage duration value data includes the one or more sets of historical growth stage duration values, the one or more observed growth stage duration values, a configured covariate matrix used to describe correlations between different growth stages of hybrid seeds, and an error matrix used to represent variations in the multivariate distribution.

The server computer system is then configured and programmed to estimate a set of mean and variance values for each growth stage for the particular hybrid seed using the generated posterior distribution of growth stage duration values. A set of crop growth stage thresholds for the particular hybrid seed are the calculated and generated from the set of mean and variance values by calculating aggregated threshold values using the growth stage duration values that precede each of the desired growth stage threshold. The server computer system is configured and programmed to send the set of crop growth stage thresholds for the particular hybrid seed to one or more external computer systems for the purposes of updating and programming crop management instructions.

2. Example Agricultural Intelligence Computer System

2.1 Structural Overview

FIG. 1 illustrates an example computer system that is configured to perform the functions described herein, shown in a field environment with other apparatus with which the system may interoperate. In one embodiment, a user 102 owns, operates or possesses a field manager computing device 104 in a field location or associated with a field location such as a field intended for agricultural activities or a management location for one or more agricultural fields. The field manager computer device 104 is programmed or configured to provide field data 106 to an agricultural intelligence computer system 130 via one or more networks 109.

Examples of field data 106 include (a) identification data (for example, acreage, field name, field identifiers, geographic identifiers, boundary identifiers, crop identifiers, and any other suitable data that may be used to identify farm land, such as a common land unit (CLU), lot and block number, a parcel number, geographic coordinates and boundaries, Farm Serial Number (FSN), farm number, tract number, field number, section, township, and/or range), (b) harvest data (for example, crop type, crop variety, crop rotation, whether the crop is grown organically, harvest date, Actual Production History (APH), expected yield, yield, crop price, crop revenue, grain moisture, tillage practice, and previous growing season information), (c) soil data (for example, type, composition, pH, organic matter (OM), cation exchange capacity (CEC)), (d) planting data (for example, planting date, seed(s) type, relative maturity (RM)

of planted seed(s), seed population), (e) fertilizer data (for example, nutrient type (Nitrogen, Phosphorous, Potassium), application type, application date, amount, source, method), (f) pesticide data (for example, pesticide, herbicide, fungicide, other substance or mixture of substances intended for use as a plant regulator, defoliant, or desiccant, application date, amount, source, method), (g) irrigation data (for example, application date, amount, source, method), (h) weather data (for example, precipitation, rainfall rate, predicted rainfall, water runoff rate region, temperature, wind, forecast, pressure, visibility, clouds, heat index, dew point, humidity, snow depth, air quality, sunrise, sunset), (i) imagery data (for example, imagery and light spectrum information from an agricultural apparatus sensor, camera, computer, smartphone, tablet, unmanned aerial vehicle, planes or satellite), (j) scouting observations (photos, videos, free form notes, voice recordings, voice transcriptions, weather conditions (temperature, precipitation (current and over time), soil moisture, crop growth stage, wind velocity, relative humidity, dew point, black layer)), and (k) soil, seed, crop phenology, pest and disease reporting, and predictions sources and databases.

A data server computer 108 is communicatively coupled to agricultural intelligence computer system 130 and is programmed or configured to send external data 110 to agricultural intelligence computer system 130 via the network(s) 109. The external data server computer 108 may be owned or operated by the same legal person or entity as the agricultural intelligence computer system 130, or by a different person or entity such as a government agency, non-governmental organization (NGO), and/or a private data service provider. Examples of external data include weather data, imagery data, soil data, or statistical data relating to crop yields, among others. External data 110 may consist of the same type of information as field data 106. In some embodiments, the external data 110 is provided by an external data server 108 owned by the same entity that owns and/or operates the agricultural intelligence computer system 130. For example, the agricultural intelligence computer system 130 may include a data server focused exclusively on a type of data that might otherwise be obtained from third party sources, such as weather data. In some embodiments, an external data server 108 may actually be incorporated within the system 130.

An agricultural apparatus 111 may have one or more remote sensors 112 fixed thereon, which sensors are communicatively coupled either directly or indirectly via agricultural apparatus 111 to the agricultural intelligence computer system 130 and are programmed or configured to send sensor data to agricultural intelligence computer system 130. Examples of agricultural apparatus 111 include tractors, combines, harvesters, planters, trucks, fertilizer equipment, unmanned aerial vehicles, and any other item of physical machinery or hardware, typically mobile machinery, and which may be used in tasks associated with agriculture. In some embodiments, a single unit of apparatus 111 may comprise a plurality of sensors 112 that are coupled locally in a network on the apparatus; controller area network (CAN) is example of such a network that can be installed in combines or harvesters. Application controller 114 is communicatively coupled to agricultural intelligence computer system 130 via the network(s) 109 and is programmed or configured to receive one or more scripts to control an operating parameter of an agricultural vehicle or implement from the agricultural intelligence computer system 130. For instance, a controller area network (CAN) bus interface may be used to enable communications from the agricultural intelligence computer system 130 to the agricultural apparatus 111, such as how the CLIMATE FIELDVIEW DRIVE, available from The Climate Corporation, San Francisco, Calif., is used. Sensor data may consist of the same type of information as field data 106. In some embodiments, remote sensors 112 may not be fixed to an agricultural apparatus 111 but may be remotely located in the field and may communicate with network 109.

The apparatus 111 may comprise a cab computer 115 that is programmed with a cab application, which may comprise a version or variant of the mobile application for device 104 that is further described in other sections herein. In an embodiment, cab computer 115 comprises a compact computer, often a tablet-sized computer or smartphone, with a graphical screen display, such as a color display, that is mounted within an operator's cab of the apparatus 111. Cab computer 115 may implement some or all of the operations and functions that are described further herein for the mobile computer device 104.

The network(s) 109 broadly represent any combination of one or more data communication networks including local area networks, wide area networks, internetworks or internets, using any of wireline or wireless links, including terrestrial or satellite links. The network(s) may be implemented by any medium or mechanism that provides for the exchange of data between the various elements of FIG. 1. The various elements of FIG. 1 may also have direct (wired or wireless) communications links. The sensors 112, controller 114, external data server computer 108, and other elements of the system each comprise an interface compatible with the network(s) 109 and are programmed or configured to use standardized protocols for communication across the networks such as TCP/IP, Bluetooth, CAN protocol and higher-layer protocols such as HTTP, TLS, and the like.

Agricultural intelligence computer system 130 is programmed or configured to receive field data 106 from field manager computing device 104, external data 110 from external data server computer 108, and sensor data from remote sensor 112. Agricultural intelligence computer system 130 may be further configured to host, use or execute one or more computer programs, other software elements, digitally programmed logic such as FPGAs or ASICs, or any combination thereof to perform translation and storage of data values, construction of digital models of one or more crops on one or more fields, generation of recommendations and notifications, and generation and sending of scripts to application controller 114, in the manner described further in other sections of this disclosure.

In an embodiment, agricultural intelligence computer system 130 is programmed with or comprises a communication layer 132, presentation layer 134, data management layer 140, hardware/virtualization layer 150, and model and field data repository 160. "Layer," in this context, refers to any combination of electronic digital interface circuits, microcontrollers, firmware such as drivers, and/or computer programs or other software elements.

Communication layer 132 may be programmed or configured to perform input/output interfacing functions including sending requests to field manager computing device 104, external data server computer 108, and remote sensor 112 for field data, external data, and sensor data respectively. Communication layer 132 may be programmed or configured to send the received data to model and field data repository 160 to be stored as field data 106.

Presentation layer 134 may be programmed or configured to generate a graphical user interface (GUI) to be displayed on field manager computing device 104, cab computer 115 or other computers that are coupled to the system 130 through the network 109. The GUI may comprise controls for inputting data to be sent to agricultural intelligence computer system 130, generating requests for models and/or recommendations, and/or displaying recommendations, notifications, models, and other field data.

Data management layer 140 may be programmed or configured to manage read operations and write operations involving the repository 160 and other functional elements of the system, including queries and result sets communicated between the functional elements of the system and the repository. Examples of data management layer 140 include JDBC, SQL server interface code, and/or HADOOP interface code, among others. Repository 160 may comprise a database. As used herein, the term "database" may refer to either a body of data, a relational database management system (RDBMS), or to both. As used herein, a database may comprise any collection of data including hierarchical databases, relational databases, flat file databases, object-relational databases, object oriented databases, and any other structured collection of records or data that is stored in a computer system. Examples of RDBMS's include, but are not limited to including, ORACLE®, MYSQL, IBM® DB2, MICROSOFT® SQL SERVER, SYBASE®, and POSTGRESQL databases. However, any database may be used that enables the systems and methods described herein.

When field data 106 is not provided directly to the agricultural intelligence computer system via one or more agricultural machines or agricultural machine devices that interacts with the agricultural intelligence computer system, the user may be prompted via one or more user interfaces on the user device (served by the agricultural intelligence computer system) to input such information. In an example embodiment, the user may specify identification data by accessing a map on the user device (served by the agricultural intelligence computer system) and selecting specific CLUs that have been graphically shown on the map. In an alternative embodiment, the user 102 may specify identification data by accessing a map on the user device (served by the agricultural intelligence computer system 130) and drawing boundaries of the field over the map. Such CLU selection or map drawings represent geographic identifiers. In alternative embodiments, the user may specify identification data by accessing field identification data (provided as shape files or in a similar format) from the U. S. Department of Agriculture Farm Service Agency or other source via the user device and providing such field identification data to the agricultural intelligence computer system.

In an example embodiment, the agricultural intelligence computer system 130 is programmed to generate and cause displaying a graphical user interface comprising a data manager for data input. After one or more fields have been identified using the methods described above, the data manager may provide one or more graphical user interface widgets which when selected can identify changes to the field, soil, crops, tillage, or nutrient practices. The data manager may include a timeline view, a spreadsheet view, and/or one or more editable programs.

Figure 5:
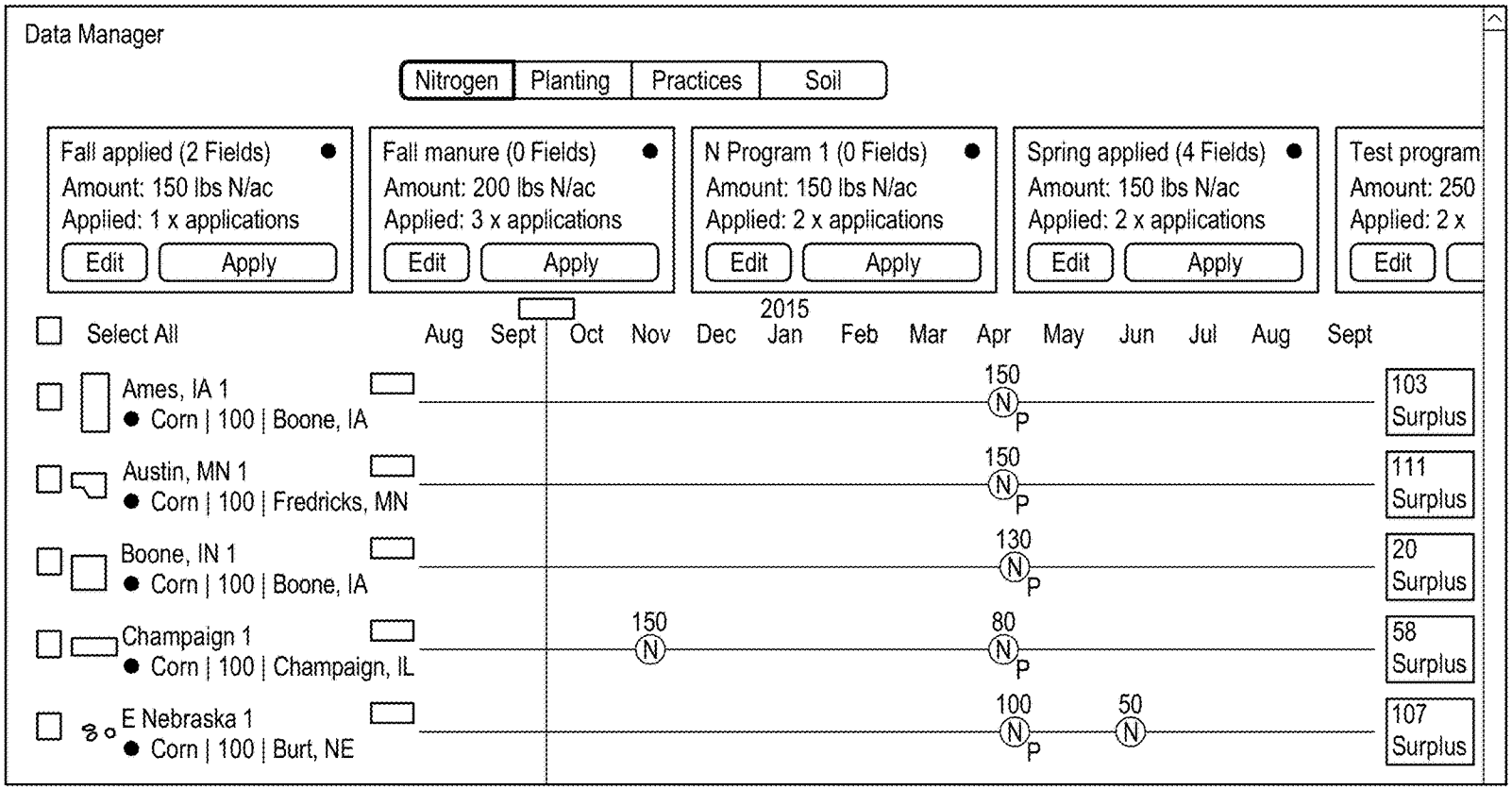
FIG. 5 depicts an example embodiment of a timeline view for data entry.

FIG. 5 depicts an example embodiment of a timeline view for data entry. Using the display depicted in FIG. 5, a user computer can input a selection of a particular field and a particular date for the addition of event. Events depicted at the top of the timeline may include Nitrogen, Planting, Practices, and Soil. To add a nitrogen application event, a user computer may provide input to select the nitrogen tab. The user computer may then select a location on the timeline for a particular field in order to indicate an application of nitrogen on the selected field. In response to receiving a selection of a location on the timeline for a particular field, the data manager may display a data entry overlay, allowing the user computer to input data pertaining to nitrogen applications, planting procedures, soil application, tillage procedures, irrigation practices, or other information relating to the particular field. For example, if a user computer selects a portion of the timeline and indicates an application of nitrogen, then the data entry overlay may include fields for inputting an amount of nitrogen applied, a date of application, a type of fertilizer used, and any other information related to the application of nitrogen.

In an embodiment, the data manager provides an interface for creating one or more programs. "Program," in this context, refers to a set of data pertaining to nitrogen applications, planting procedures, soil application, tillage procedures, irrigation practices, or other information that may be related to one or more fields, and that can be stored in digital data storage for reuse as a set in other operations. After a program has been created, it may be conceptually applied to one or more fields and references to the program may be stored in digital storage in association with data identifying the fields. Thus, instead of manually entering identical data relating to the same nitrogen applications for multiple different fields, a user computer may create a program that indicates a particular application of nitrogen and then apply the program to multiple different fields. For example, in the timeline view of FIG. 5, the top two timelines have the "Fall applied" program selected, which includes an application of 150 lbs N/ac in early April. The data manager may provide an interface for editing a program. In an embodiment, when a particular program is edited, each field that has selected the particular program is edited. For example, in FIG. 5, if the "Fall applied" program is edited to reduce the application of nitrogen to 130 lbs N/ac, the top two fields may be updated with a reduced application of nitrogen based on the edited program.

In an embodiment, in response to receiving edits to a field that has a program selected, the data manager removes the correspondence of the field to the selected program. For example, if a nitrogen application is added to the top field in FIG. 5, the interface may update to indicate that the "Fall applied" program is no longer being applied to the top field. While the nitrogen application in early April may remain, updates to the "Fall applied" program would not alter the April application of nitrogen.

Figure 6:
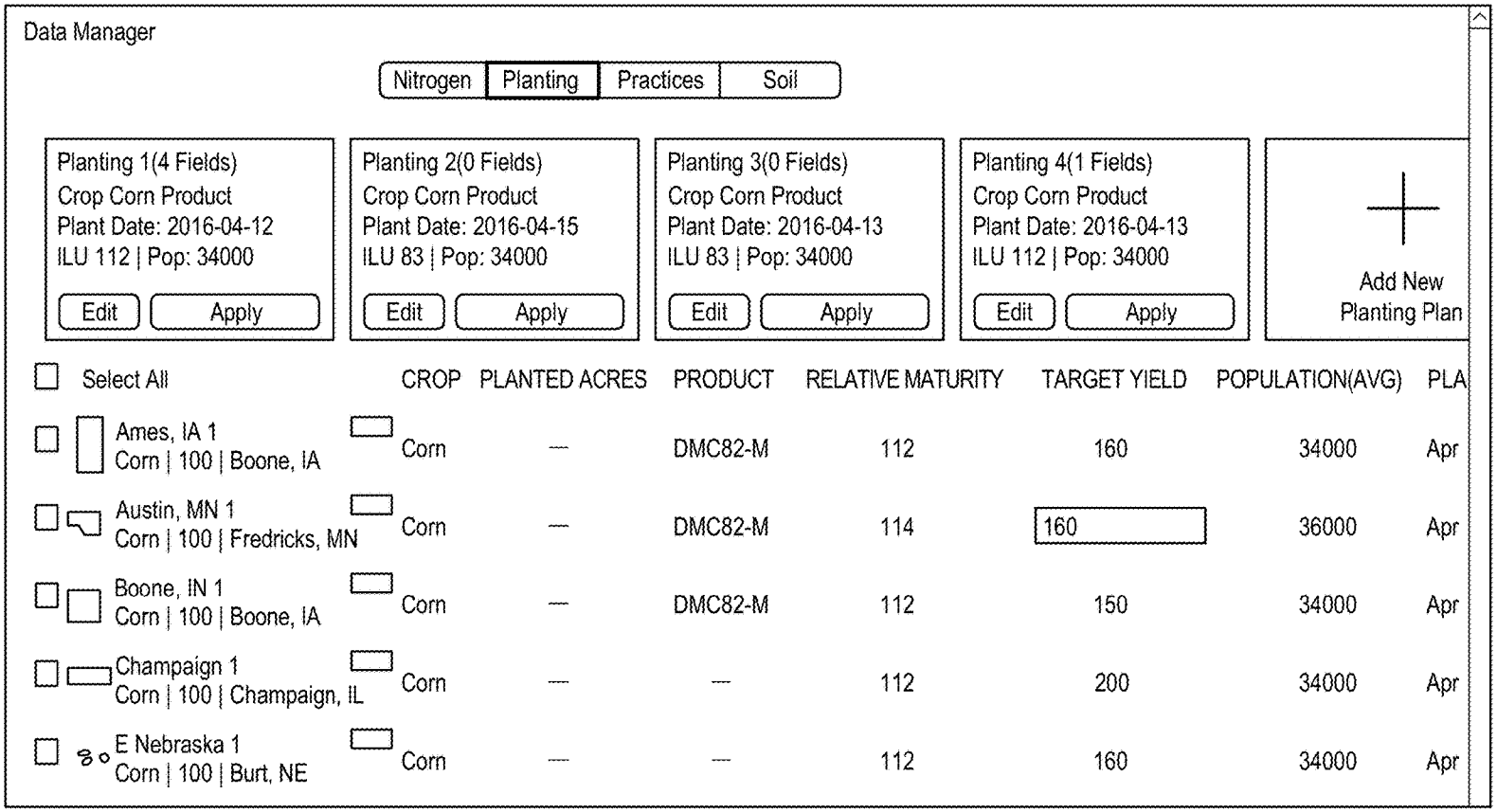
FIG. 6 depicts an example embodiment of a spreadsheet view for data entry.

FIG. 6 depicts an example embodiment of a spreadsheet view for data entry. Using the display depicted in FIG. 6, a user can create and edit information for one or more fields. The data manager may include spreadsheets for inputting information with respect to Nitrogen, Planting, Practices, and Soil as depicted in FIG. 6. To edit a particular entry, a user computer may select the particular entry in the spreadsheet and update the values. For example, FIG. 6 depicts an in-progress update to a target yield value for the second field. Additionally, a user computer may select one or more fields in order to apply one or more programs. In response to receiving a selection of a program for a particular field, the data manager may automatically complete the entries for the particular field based on the selected program. As with the timeline view, the data manager may update the entries for each field associated with a particular program in response to receiving an update to the program. Additionally, the data manager may remove the correspondence of the selected program to the field in response to receiving an edit to one of the entries for the field.

In an embodiment, model and field data is stored in model and field data repository 160. Model data comprises data models created for one or more fields. For example, a crop model may include a digitally constructed model of the development of a crop on the one or more fields. "Model," in this context, refers to an electronic digitally stored set of executable instructions and data values, associated with one another, which are capable of receiving and responding to a programmatic or other digital call, invocation, or request for resolution based upon specified input values, to yield one or more stored output values that can serve as the basis of computer-implemented recommendations, output data displays, or machine control, among other things. Persons of skill in the field find it convenient to express models using mathematical equations, but that form of expression does not confine the models disclosed herein to abstract concepts; instead, each model herein has a practical application in a computer in the form of stored executable instructions and data that implement the model using the computer. The model may include a model of past events on the one or more fields, a model of the current status of the one or more fields, and/or a model of predicted events on the one or more fields. Model and field data may be stored in data structures in memory, rows in a database table, in flat files or spreadsheets, or other forms of stored digital data.

In an embodiment, the data assimilation subsystem 170 contains specially configured logic, including, but not limited to, growth stage threshold transformation instructions 172, growth stage estimation instructions 174, correlation parameter generation instructions 176, and threshold calculation instructions 178. Each of the growth stage threshold transformation instructions 172, the growth stage estimation instructions 174, the correlation parameter generation instructions 176, and the threshold calculation instructions 178 comprises a set of one or more pages of main memory, such as RAM, in the agricultural intelligence computer system 130 into which executable instructions have been loaded and which when executed cause the agricultural intelligence computing system to perform the functions or operations that are described herein with reference to those modules. For example, the nutrient modeling instructions 135 may comprise a set of pages in RAM that contain instructions which when executed cause performing the nutrient modeling functions that are described herein. The instructions may be in machine executable code in the instruction set of a CPU and may have been compiled based upon source code written in JAVA, C, C++, OBJECTIVE-C, or any other human-readable programming language or environment, alone or in combination with scripts in JAVASCRIPT, other scripting languages and other programming source text. The term "pages" is intended to refer broadly to any region within main memory and the specific terminology used in a system may vary depending on the memory architecture or processor architecture. In another embodiment, each of the growth stage threshold transformation instructions 172, the growth stage estimation instructions 174, the correlation parameter generation instructions 176, and the threshold calculation instructions 178 also may represent one or more files or projects of source code that are digitally stored in a mass storage device such as non-volatile RAM or disk storage, in the agricultural intelligence computer system 130 or a separate repository system, which when compiled or interpreted cause generating executable instructions which when executed cause the agricultural intelligence computing system to perform the functions or operations that are described herein with reference to those modules. In other words, the drawing figure may represent the manner in which programmers or software developers organize and arrange source code for later compilation into an executable, or interpretation into bytecode or the equivalent, for execution by the agricultural intelligence computer system 130.

Figure 4:
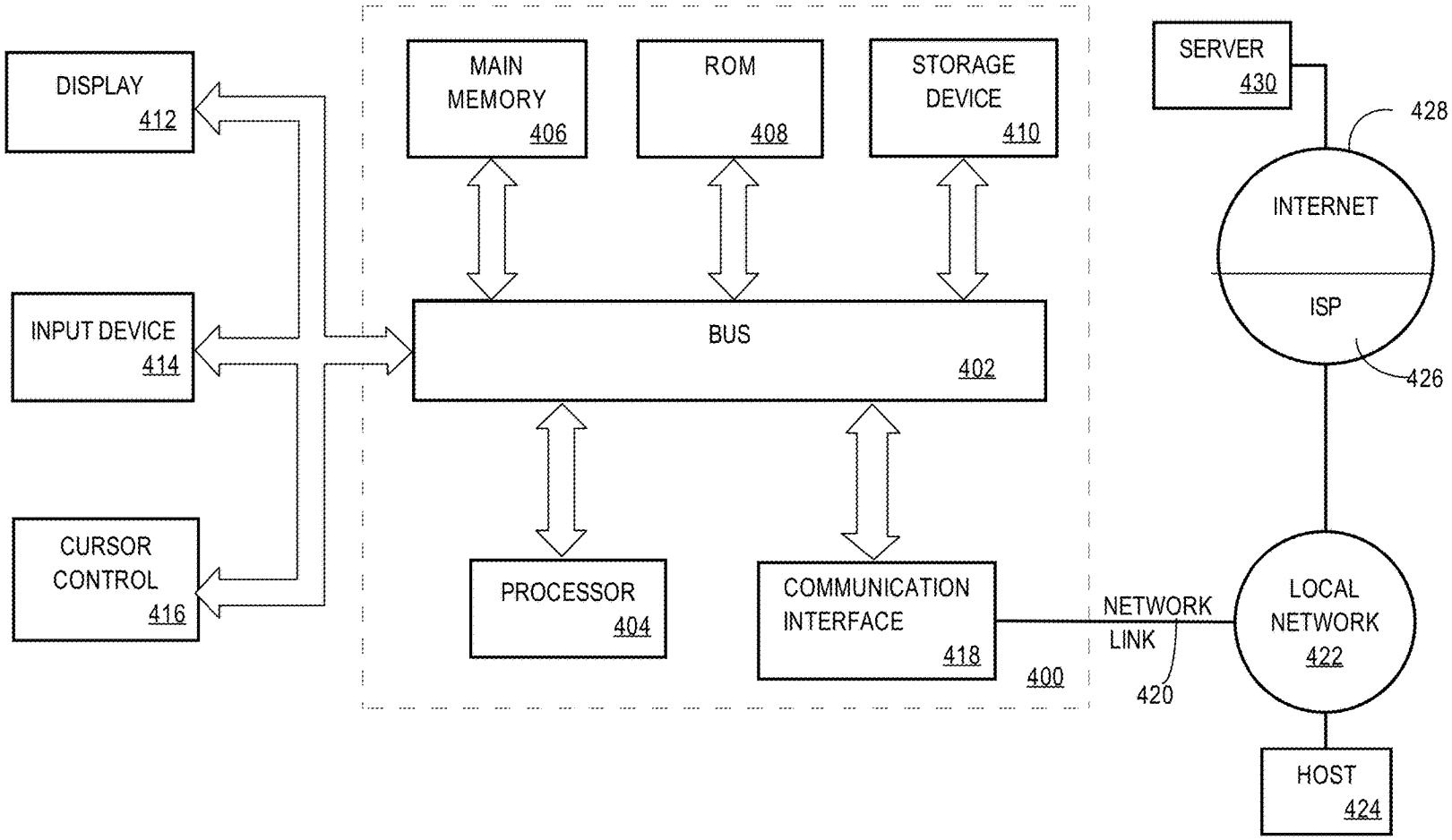
FIG. 4 is a block diagram that illustrates a computer system upon which an embodiment of the invention may be implemented.

Hardware/virtualization layer 150 comprises one or more central processing units (CPUs), memory controllers, and other devices, components, or elements of a computer system such as volatile or non-volatile memory, non-volatile storage such as disk, and I/O devices or interfaces as illustrated and described, for example, in connection with FIG. 4. The layer 150 also may comprise programmed instructions that are configured to support virtualization, containerization, or other technologies.

For purposes of illustrating a clear example, FIG. 1 shows a limited number of instances of certain functional elements. However, in other embodiments, there may be any number of such elements. For example, embodiments may use thousands or millions of different mobile computing devices 104 associated with different users. Further, the system 130 and/or external data server computer 108 may be implemented using two or more processors, cores, clusters, or instances of physical machines or virtual machines, configured in a discrete location or co-located with other elements in a datacenter, shared computing facility or cloud computing facility.

2.2. Application Program Overview

In an embodiment, the implementation of the functions described herein using one or more computer programs or other software elements that are loaded into and executed using one or more general-purpose computers will cause the general-purpose computers to be configured as a particular machine or as a computer that is specially adapted to perform the functions described herein. Further, each of the flow diagrams that are described further herein may serve, alone or in combination with the descriptions of processes and functions in prose herein, as algorithms, plans or directions that may be used to program a computer or logic to implement the functions that are described. In other words, all the prose text herein, and all the drawing figures, together are intended to provide disclosure of algorithms, plans or directions that are sufficient to permit a skilled person to program a computer to perform the functions that are described herein, in combination with the skill and knowledge of such a person given the level of skill that is appropriate for inventions and disclosures of this type.

In an embodiment, user 102 interacts with agricultural intelligence computer system 130 using field manager computing device 104 configured with an operating system and one or more application programs or apps; the field manager computing device 104 also may interoperate with the agricultural intelligence computer system independently and automatically under program control or logical control and direct user interaction is not always required. Field manager computing device 104 broadly represents one or more of a smart phone, PDA, tablet computing device, laptop computer, desktop computer, workstation, or any other computing device capable of transmitting and receiving information and performing the functions described herein. Field manager computing device 104 may communicate via a network using a mobile application stored on field manager computing device 104, and in some embodiments, the device may be coupled using a cable 113 or connector to the sensor 112 and/or controller 114. A particular user 102 may own, operate or possess and use, in connection with system 130, more than one field manager computing device 104 at a time.

The mobile application may provide client-side functionality, via the network to one or more mobile computing devices. In an example embodiment, field manager computing device 104 may access the mobile application via a web browser or a local client application or app. Field manager computing device 104 may transmit data to, and receive data from, one or more front-end servers, using web-based protocols or formats such as HTTP, XML and/or JSON, or app-specific protocols. In an example embodiment, the data may take the form of requests and user information input, such as field data, into the mobile computing device. In some embodiments, the mobile application interacts with location tracking hardware and software on field manager computing device 104 which determines the location of field manager computing device 104 using standard tracking techniques such as multilateration of radio signals, the global positioning system (GPS), WiFi positioning systems, or other methods of mobile positioning. In some cases, location data or other data associated with the device 104, user 102, and/or user account(s) may be obtained by queries to an operating system of the device or by requesting an app on the device to obtain data from the operating system.

In an embodiment, field manager computing device 104 sends field data 106 to agricultural intelligence computer system 130 comprising or including, but not limited to, data values representing one or more of: a geographical location of the one or more fields, tillage information for the one or more fields, crops planted in the one or more fields, and soil data extracted from the one or more fields. Field manager computing device 104 may send field data 106 in response to user input from user 102 specifying the data values for the one or more fields. Additionally, field manager computing device 104 may automatically send field data 106 when one or more of the data values becomes available to field manager computing device 104. For example, field manager computing device 104 may be communicatively coupled to remote sensor 112 and/or application controller 114. In response to receiving data indicating that application controller 114 released water onto the one or more fields, field manager computing device 104 may send field data 106 to agricultural intelligence computer system 130 indicating that water was released on the one or more fields. Field data 106 identified in this disclosure may be input and communicated using electronic digital data that is communicated between computing devices using parameterized URLs over HTTP, or another suitable communication or messaging protocol.

A commercial example of the mobile application is CLIMATE FIELDVIEW, commercially available from The Climate Corporation, San Francisco, Calif. The CLIMATE FIELDVIEW application, or other applications, may be modified, extended, or adapted to include features, functions, and programming that have not been disclosed earlier than the filing date of this disclosure. In one embodiment, the mobile application comprises an integrated software platform that allows a grower to make fact-based decisions for their operation because it combines historical data about the grower's fields with any other data that the grower wishes to compare. The combinations and comparisons may be performed in real time and are based upon scientific models that provide potential scenarios to permit the grower to make better, more informed decisions.

Figure 2:
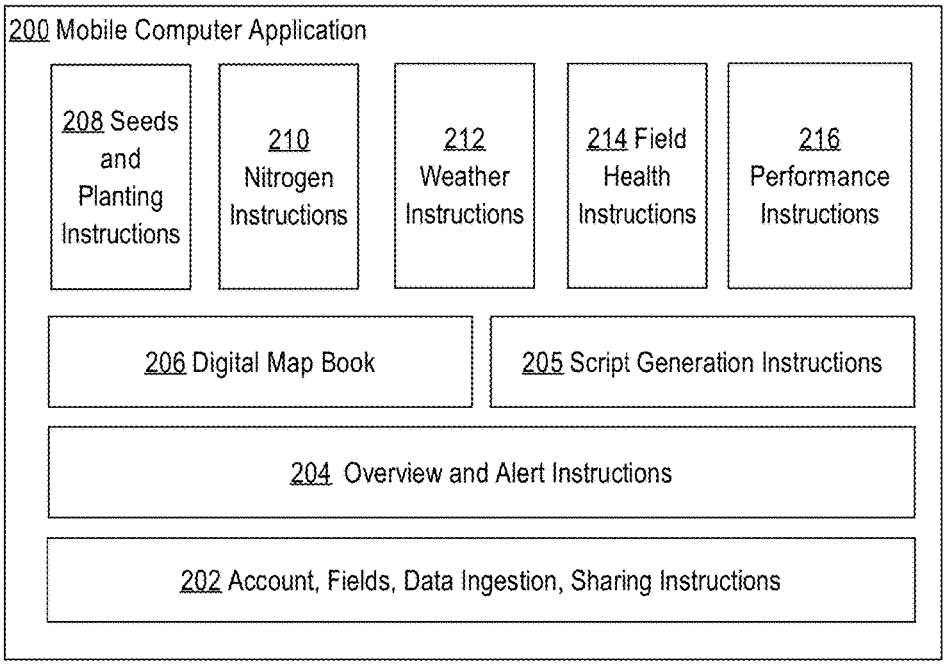
FIG. 2 illustrates two views of an example logical organization of sets of instructions in main memory when an example mobile application is loaded for execution.
Figure 2:
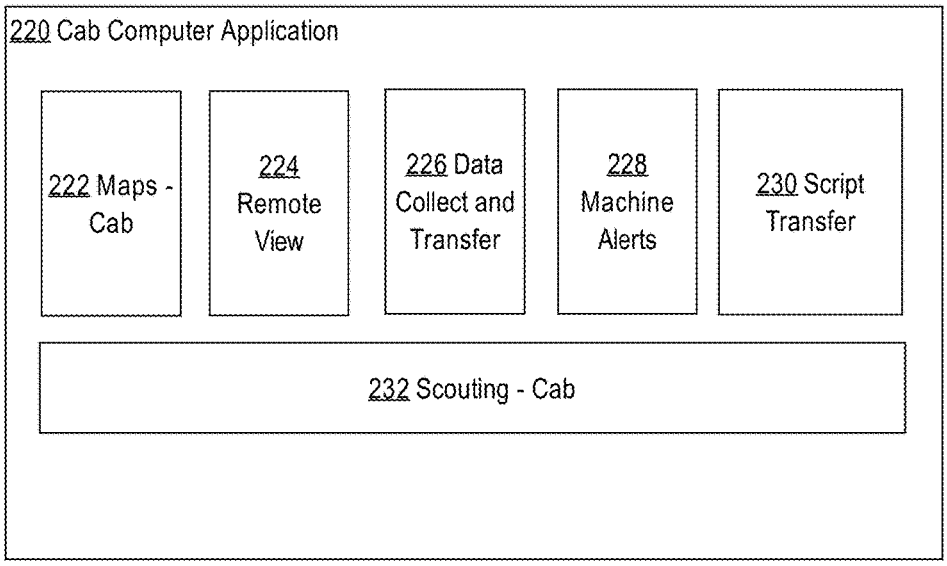

FIG. 2 illustrates two views of an example logical organization of sets of instructions in main memory when an example mobile application is loaded for execution. In FIG. 2, each named element represents a region of one or more pages of RAM or other main memory, or one or more blocks of disk storage or other non-volatile storage, and the programmed instructions within those regions. In one embodiment, in view (a), a mobile computer application 200 comprises account-fields-data ingestion-sharing instructions 202, overview and alert instructions 204, digital map book instructions 206, seeds and planting instructions 208, nitrogen instructions 210, weather instructions 212, field health instructions 214, and performance instructions 216.

In one embodiment, a mobile computer application 200 comprises account-fields-data ingestion-sharing instructions 202 which are programmed to receive, translate, and ingest field data from third party systems via manual upload or APIs. Data types may include field boundaries, yield maps, as-planted maps, soil test results, as-applied maps, and/or management zones, among others. Data formats may include shape files, native data formats of third parties, and/or farm management information system (FMIS) exports, among others. Receiving data may occur via manual upload, e-mail with attachment, external APIs that push data to the mobile application, or instructions that call APIs of external systems to pull data into the mobile application. In one embodiment, mobile computer application 200 comprises a data inbox. In response to receiving a selection of the data inbox, the mobile computer application 200 may display a graphical user interface for manually uploading data files and importing uploaded files to a data manager.

In one embodiment, digital map book instructions 206 comprise field map data layers stored in device memory and are programmed with data visualization tools and geospatial field notes. This provides growers with convenient information close at hand for reference, logging and visual insights into field performance. In one embodiment, overview and alert instructions 204 are programmed to provide an operation-wide view of what is important to the grower, and timely recommendations to take action or focus on particular issues. This permits the grower to focus time on what needs attention, to save time and preserve yield throughout the season. In one embodiment, seeds and planting instructions 208 are programmed to provide tools for seed selection, hybrid placement, and script creation, including variable rate (VR) script creation, based upon scientific models and empirical data. This enables growers to maximize yield or return on investment through optimized seed purchase, placement and population.

In one embodiment, script generation instructions 205 are programmed to provide an interface for generating scripts, including variable rate (VR) fertility scripts. The interface enables growers to create scripts for field implements, such as nutrient applications, planting, and irrigation. For example, a planting script interface may comprise tools for identifying a type of seed for planting. Upon receiving a selection of the seed type, mobile computer application 200 may display one or more fields broken into management zones, such as the field map data layers created as part of digital map book instructions 206. In one embodiment, the management zones comprise soil zones along with a panel identifying each soil zone and a soil name, texture, drainage for each zone, or other field data. Mobile computer application 200 may also display tools for editing or creating such, such as graphical tools for drawing management zones, such as soil zones, over a map of one or more fields. Planting procedures may be applied to all management zones or different planting procedures may be applied to different subsets of management zones. When a script is created, mobile computer application 200 may make the script available for download in a format readable by an application controller, such as an archived or compressed format. Additionally, and/or alternatively, a script may be sent directly to cab computer 115 from mobile computer application 200 and/or uploaded to one or more data servers and stored for further use.

In one embodiment, nitrogen instructions 210 are programmed to provide tools to inform nitrogen decisions by visualizing the availability of nitrogen to crops. This enables growers to maximize yield or return on investment through optimized nitrogen application during the season. Example programmed functions include displaying images such as SSURGO images to enable drawing of application zones and/or images generated from subfield soil data, such as data obtained from sensors, at a high spatial resolution (as fine as 10 meters or smaller because of their proximity to the soil); upload of existing grower-defined zones; providing an application graph and/or a map to enable tuning application(s) of nitrogen across multiple zones; output of scripts to drive machinery; tools for mass data entry and adjustment; and/or maps for data visualization, among others. "Mass data entry," in this context, may mean entering data once and then applying the same data to multiple fields that have been defined in the system; example data may include nitrogen application data that is the same for many fields of the same grower, but such mass data entry applies to the entry of any type of field data into the mobile computer application 200. For example, nitrogen instructions 210 may be programmed to accept definitions of nitrogen planting and practices programs and to accept user input specifying to apply those programs across multiple fields. "Nitrogen planting programs," in this context, refers to a stored, named set of data that associates: a name, color code or other identifier, one or more dates of application, types of material or product for each of the dates and amounts, method of application or incorporation such as injected or knifed in, and/or amounts or rates of application for each of the dates, crop or hybrid that is the subject of the application, among others. "Nitrogen practices programs," in this context, refers to a stored, named set of data that associates: a practices name; a previous crop; a tillage system; a date of primarily tillage; one or more previous tillage systems that were used; one or more indicators of application type, such as manure, that were used. Nitrogen instructions 210 also may be programmed to generate and cause displaying a nitrogen graph, which indicates projections of plant use of the specified nitrogen and whether a surplus or shortfall is predicted; in some embodiments, different color indicators may signal a magnitude of surplus or magnitude of shortfall. In one embodiment, a nitrogen graph comprises a graphical display in a computer display device comprising a plurality of rows, each row associated with and identifying a field; data specifying what crop is planted in the field, the field size, the field location, and a graphic representation of the field perimeter; in each row, a timeline by month with graphic indicators specifying each nitrogen application and amount at points correlated to month names; and numeric and/or colored indicators of surplus or shortfall, in which color indicates magnitude.

In one embodiment, the nitrogen graph may include one or more user input features, such as dials or slider bars, to dynamically change the nitrogen planting and practices programs so that a user may optimize his nitrogen graph. The user may then use his optimized nitrogen graph and the related nitrogen planting and practices programs to implement one or more scripts, including variable rate (VR) fertility scripts. Nitrogen instructions 210 also may be programmed to generate and cause displaying a nitrogen map, which indicates projections of plant use of the specified nitrogen and whether a surplus or shortfall is predicted; in some embodiments, different color indicators may signal a magnitude of surplus or magnitude of shortfall. The nitrogen map may display projections of plant use of the specified nitrogen and whether a surplus or shortfall is predicted for different times in the past and the future (such as daily, weekly, monthly or yearly) using numeric and/or colored indicators of surplus or shortfall, in which color indicates magnitude. In one embodiment, the nitrogen map may include one or more user input features, such as dials or slider bars, to dynamically change the nitrogen planting and practices programs so that a user may optimize his nitrogen map, such as to obtain a preferred amount of surplus to shortfall. The user may then use his optimized nitrogen map and the related nitrogen planting and practices programs to implement one or more scripts, including variable rate (VR) fertility scripts. In other embodiments, similar instructions to the nitrogen instructions 210 could be used for application of other nutrients (such as phosphorus and potassium) application of pesticide, and irrigation programs.

In one embodiment, weather instructions 212 are programmed to provide field-specific recent weather data and forecasted weather information. This enables growers to save time and have an efficient integrated display with respect to daily operational decisions.

In one embodiment, field health instructions 214 are programmed to provide timely remote sensing images highlighting in-season crop variation and potential concerns. Example programmed functions include cloud checking, to identify possible clouds or cloud shadows; determining nitrogen indices based on field images; graphical visualization of scouting layers, including, for example, those related to field health, and viewing and/or sharing of scouting notes; and/or downloading satellite images from multiple sources and prioritizing the images for the grower, among others.

In one embodiment, performance instructions 216 are programmed to provide reports, analysis, and insight tools using on-farm data for evaluation, insights and decisions. This enables the grower to seek improved outcomes for the next year through fact-based conclusions about why return on investment was at prior levels, and insight into yield-limiting factors. The performance instructions 216 may be programmed to communicate via the network(s) 109 to back-end analytics programs executed at agricultural intelligence computer system 130 and/or external data server computer 108 and configured to analyze metrics such as yield, hybrid, population, SSURGO, soil tests, or elevation, among others. Programmed reports and analysis may include yield variability analysis, benchmarking of yield and other metrics against other growers based on anonymized data collected from many growers, or data for seeds and planting, among others.

Applications having instructions configured in this way may be implemented for different computing device platforms while retaining the same general user interface appearance. For example, the mobile application may be programmed for execution on tablets, smartphones, or server computers that are accessed using browsers at client computers. Further, the mobile application as configured for tablet computers or smartphones may provide a full app experience or a cab app experience that is suitable for the display and processing capabilities of cab computer 115. For example, referring now to view (b) of FIG. 2, in one embodiment a cab computer application 220 may comprise maps-cab instructions 222, remote view instructions 224, data collect and transfer instructions 226, machine alerts instructions 228, script transfer instructions 230, and scouting-cab instructions 232. The code base for the instructions of view (b) may be the same as for view (a) and executables implementing the code may be programmed to detect the type of platform on which they are executing and to expose, through a graphical user interface, only those functions that are appropriate to a cab platform or full platform. This approach enables the system to recognize the distinctly different user experience that is appropriate for an in-cab environment and the different technology environment of the cab. The maps-cab instructions 222 may be programmed to provide map views of fields, farms or regions that are useful in directing machine operation. The remote view instructions 224 may be programmed to turn on, manage, and provide views of machine activity in real-time or near real-time to other computing devices connected to the system 130 via wireless networks, wired connectors or adapters, and the like. The data collect and transfer instructions 226 may be programmed to turn on, manage, and provide transfer of data collected at sensors and controllers to the system 130 via wireless networks, wired connectors or adapters, and the like. The machine alerts instructions 228 may be programmed to detect issues with operations of the machine or tools that are associated with the cab and generate operator alerts. The script transfer instructions 230 may be configured to transfer in scripts of instructions that are configured to direct machine operations or the collection of data. The scouting-cab instructions 230 may be programmed to display location-based alerts and information received from the system 130 based on the location of the agricultural apparatus 111 or sensors 112 in the field and ingest, manage, and provide transfer of location-based scouting observations to the system 130 based on the location of the agricultural apparatus 111 or sensors 112 in the field.

2.3. Data Ingest to the Computer System

In an embodiment, external data server computer 108 stores external data 110, including soil data representing soil composition for the one or more fields and weather data representing temperature and precipitation on the one or more fields. The weather data may include past and present weather data as well as forecasts for future weather data. In an embodiment, external data server computer 108 comprises a plurality of servers hosted by different entities. For example, a first server may contain soil composition data while a second server may include weather data. Additionally, soil composition data may be stored in multiple servers. For example, one server may store data representing percentage of sand, silt, and clay in the soil while a second server may store data representing percentage of organic matter (OM) in the soil.

In an embodiment, remote sensor 112 comprises one or more sensors that are programmed or configured to produce one or more observations. Remote sensor 112 may be aerial sensors, such as satellites, vehicle sensors, planting equipment sensors, tillage sensors, fertilizer or insecticide application sensors, harvester sensors, and any other implement capable of receiving data from the one or more fields. In an embodiment, application controller 114 is programmed or configured to receive instructions from agricultural intelligence computer system 130. Application controller 114 may also be programmed or configured to control an operating parameter of an agricultural vehicle or implement. For example, an application controller may be programmed or configured to control an operating parameter of a vehicle, such as a tractor, planting equipment, tillage equipment, fertilizer or insecticide equipment, harvester equipment, or other farm implements such as a water valve. Other embodiments may use any combination of sensors and controllers, of which the following are merely selected examples.

The system 130 may obtain or ingest data under user 102 control, on a mass basis from a large number of growers who have contributed data to a shared database system. This form of obtaining data may be termed "manual data ingest" as one or more user-controlled computer operations are requested or triggered to obtain data for use by the system 130. As an example, the CLIMATE FIELDVIEW application, commercially available from The Climate Corporation, San Francisco, Calif., may be operated to export data to system 130 for storing in the repository 160.

For example, seed monitor systems can both control planter apparatus components and obtain planting data, including signals from seed sensors via a signal harness that comprises a CAN backbone and point-to-point connections for registration and/or diagnostics. Seed monitor systems can be programmed or configured to display seed spacing, population and other information to the user via the cab computer 115 or other devices within the system 130. Examples are disclosed in U.S. Pat. No. 8,738,243 and US Pat. Pub. 20150094916, and the present disclosure assumes knowledge of those other patent disclosures.

Likewise, yield monitor systems may contain yield sensors for harvester apparatus that send yield measurement data to the cab computer 115 or other devices within the system 130. Yield monitor systems may utilize one or more remote sensors 112 to obtain grain moisture measurements in a combine or other harvester and transmit these measurements to the user via the cab computer 115 or other devices within the system 130.

In an embodiment, examples of sensors 112 that may be used with any moving vehicle or apparatus of the type described elsewhere herein include kinematic sensors and position sensors. Kinematic sensors may comprise any of speed sensors such as radar or wheel speed sensors, accelerometers, or gyros. Position sensors may comprise GPS receivers or transceivers, or WiFi-based position or mapping apps that are programmed to determine location based upon nearby WiFi hotspots, among others.

In an embodiment, examples of sensors 112 that may be used with tractors or other moving vehicles include engine speed sensors, fuel consumption sensors, area counters or distance counters that interact with GPS or radar signals, PTO (power take-off) speed sensors, tractor hydraulics sensors configured to detect hydraulics parameters such as pressure or flow, and/or and hydraulic pump speed, wheel speed sensors or wheel slippage sensors. In an embodiment, examples of controllers 114 that may be used with tractors include hydraulic directional controllers, pressure controllers, and/or flow controllers; hydraulic pump speed controllers; speed controllers or governors; hitch position controllers; or wheel position controllers provide automatic steering.

In an embodiment, examples of sensors 112 that may be used with seed planting equipment such as planters, drills, or air seeders include seed sensors, which may be optical, electromagnetic, or impact sensors; downforce sensors such as load pins, load cells, pressure sensors; soil property sensors such as reflectivity sensors, moisture sensors, electrical conductivity sensors, optical residue sensors, or temperature sensors; component operating criteria sensors such as planting depth sensors, downforce cylinder pressure sensors, seed disc speed sensors, seed drive motor encoders, seed conveyor system speed sensors, or vacuum level sensors; or pesticide application sensors such as optical or other electromagnetic sensors, or impact sensors. In an embodiment, examples of controllers 114 that may be used with such seed planting equipment include: toolbar fold controllers, such as controllers for valves associated with hydraulic cylinders; downforce controllers, such as controllers for valves associated with pneumatic cylinders, airbags, or hydraulic cylinders, and programmed for applying downforce to individual row units or an entire planter frame; planting depth controllers, such as linear actuators; metering controllers, such as electric seed meter drive motors, hydraulic seed meter drive motors, or swath control clutches; hybrid selection controllers, such as seed meter drive motors, or other actuators programmed for selectively allowing or preventing seed or an air-seed mixture from delivering seed to or from seed meters or central bulk hoppers; metering controllers, such as electric seed meter drive motors, or hydraulic seed meter drive motors; seed conveyor system controllers, such as controllers for a belt seed delivery conveyor motor; marker controllers, such as a controller for a pneumatic or hydraulic actuator; or pesticide application rate controllers, such as metering drive controllers, orifice size or position controllers.

In an embodiment, examples of sensors 112 that may be used with tillage equipment include position sensors for tools such as shanks or discs; tool position sensors for such tools that are configured to detect depth, gang angle, or lateral spacing; downforce sensors; or draft force sensors. In an embodiment, examples of controllers 114 that may be used with tillage equipment include downforce controllers or tool position controllers, such as controllers configured to control tool depth, gang angle, or lateral spacing.

In an embodiment, examples of sensors 112 that may be used in relation to apparatus for applying fertilizer, insecticide, fungicide and the like, such as on-planter starter fertilizer systems, subsoil fertilizer applicators, or fertilizer sprayers, include: fluid system criteria sensors, such as flow sensors or pressure sensors; sensors indicating which spray head valves or fluid line valves are open; sensors associated with tanks, such as fill level sensors; sectional or system-wide supply line sensors, or row-specific supply line sensors; or kinematic sensors such as accelerometers disposed on sprayer booms. In an embodiment, examples of controllers 114 that may be used with such apparatus include pump speed controllers; valve controllers that are programmed to control pressure, flow, direction, PWM and the like; or position actuators, such as for boom height, subsoiler depth, or boom position.

In an embodiment, examples of sensors 112 that may be used with harvesters include yield monitors, such as impact plate strain gauges or position sensors, capacitive flow sensors, load sensors, weight sensors, or torque sensors associated with elevators or augers, or optical or other electromagnetic grain height sensors; grain moisture sensors, such as capacitive sensors; grain loss sensors, including impact, optical, or capacitive sensors; header operating criteria sensors such as header height, header type, deck plate gap, feeder speed, and reel speed sensors; separator operating criteria sensors, such as concave clearance, rotor speed, shoe clearance, or chaffer clearance sensors; auger sensors for position, operation, or speed; or engine speed sensors. In an embodiment, examples of controllers 114 that may be used with harvesters include header operating criteria controllers for elements such as header height, header type, deck plate gap, feeder speed, or reel speed; separator operating criteria controllers for features such as concave clearance, rotor speed, shoe clearance, or chaffer clearance; or controllers for auger position, operation, or speed.

In an embodiment, examples of sensors 112 that may be used with grain carts include weight sensors, or sensors for auger position, operation, or speed. In an embodiment, examples of controllers 114 that may be used with grain carts include controllers for auger position, operation, or speed.

In an embodiment, examples of sensors 112 and controllers 114 may be installed in unmanned aerial vehicle (UAV) apparatus or "drones." Such sensors may include cameras with detectors effective for any range of the electromagnetic spectrum including visible light, infrared, ultraviolet, near-infrared (NIR), and the like; accelerometers; altimeters; temperature sensors; humidity sensors; pitot tube sensors or other airspeed or wind velocity sensors; battery life sensors; or radar emitters and reflected radar energy detection apparatus. Such controllers may include guidance or motor control apparatus, control surface controllers, camera controllers, or controllers programmed to turn on, operate, obtain data from, manage and configure any of the foregoing sensors. Examples are disclosed in U.S. patent application Ser. No. 14/831,165 and the present disclosure assumes knowledge of that other patent disclosure.

In an embodiment, sensors 112 and controllers 114 may be affixed to soil sampling and measurement apparatus that is configured or programmed to sample soil and perform soil chemistry tests, soil moisture tests, and other tests pertaining to soil. For example, the apparatus disclosed in U.S. Pat. Nos. 8,767,194 and 8,712,148 may be used, and the present disclosure assumes knowledge of those patent disclosures.

In an embodiment, sensors 112 and controllers 114 may comprise weather devices for monitoring weather conditions of fields. For example, the apparatus disclosed in U.S. Provisional Application No. 62/154,207, filed on Apr. 29, 2015, U.S. Provisional Application No. 62/175,160, filed on Jun. 12, 2015, U.S. Provisional Application No. 62/198,060, filed on Jul. 28, 2015, and U.S. Provisional Application No. 62/220,852, filed on Sep. 18, 2015, may be used, and the present disclosure assumes knowledge of those patent disclosures.

2.4 Process Overview-Agronomic Model Training

In an embodiment, the agricultural intelligence computer system 130 is programmed or configured to create an agronomic model. In this context, an agronomic model is a data structure in memory of the agricultural intelligence computer system 130 that comprises field data 106, such as identification data and harvest data for one or more fields. The agronomic model may also comprise calculated agronomic properties which describe either conditions which may affect the growth of one or more crops on a field, or properties of the one or more crops, or both. Additionally, an agronomic model may comprise recommendations based on agronomic factors such as crop recommendations, irrigation recommendations, planting recommendations, and harvesting recommendations. The agronomic factors may also be used to estimate one or more crop related results, such as agronomic yield. The agronomic yield of a crop is an estimate of quantity of the crop that is produced, or in some examples the revenue or profit obtained from the produced crop.

In an embodiment, the agricultural intelligence computer system 130 may use a preconfigured agronomic model to calculate agronomic properties related to currently received location and crop information for one or more fields. The preconfigured agronomic model is based upon previously processed field data, including but not limited to, identification data, harvest data, fertilizer data, and weather data. The preconfigured agronomic model may have been cross validated to ensure accuracy of the model. Cross validation may include comparison to ground truthing that compares predicted results with actual results on a field, such as a comparison of precipitation estimate with a rain gauge or sensor providing weather data at the same or nearby location or an estimate of nitrogen content with a soil sample measurement.

Figure 3:
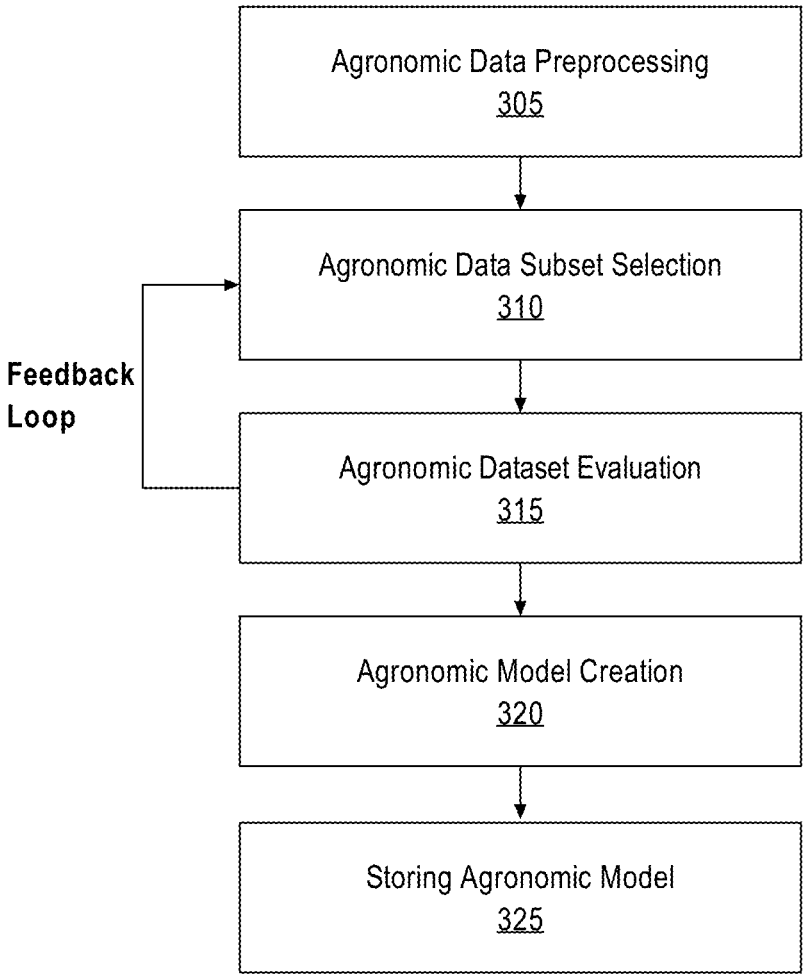
FIG. 3 illustrates a programmed process by which the agricultural intelligence computer system generates one or more preconfigured agronomic models using agronomic data provided by one or more data sources.

FIG. 3 illustrates a programmed process by which the agricultural intelligence computer system generates one or more preconfigured agronomic models using field data provided by one or more data sources. FIG. 3 may serve as an algorithm or instructions for programming the functional elements of the agricultural intelligence computer system 130 to perform the operations that are now described.

At block 305, the agricultural intelligence computer system 130 is configured or programmed to implement agronomic data preprocessing of field data received from one or more data sources. The field data received from one or more data sources may be preprocessed for the purpose of removing noise and distorting effects within the agronomic data including measured outliers that would bias received field data values. Embodiments of agronomic data preprocessing may include, but are not limited to, removing data values commonly associated with outlier data values, specific measured data points that are known to unnecessarily skew other data values, data smoothing techniques used to remove or reduce additive or multiplicative effects from noise, and other filtering or data derivation techniques used to provide clear distinctions between positive and negative data inputs.

At block 310, the agricultural intelligence computer system 130 is configured or programmed to perform data subset selection using the preprocessed field data in order to identify datasets useful for initial agronomic model generation. The agricultural intelligence computer system 130 may implement data subset selection techniques including, but not limited to, a genetic algorithm method, an all subset models method, a sequential search method, a stepwise regression method, a particle swarm optimization method, and an ant colony optimization method. For example, a genetic algorithm selection technique uses an adaptive heuristic search algorithm, based on evolutionary principles of natural selection and genetics, to determine and evaluate datasets within the preprocessed agronomic data.

At block 315, the agricultural intelligence computer system 130 is configured or programmed to implement field dataset evaluation. In an embodiment, a specific field dataset is evaluated by creating an agronomic model and using specific quality thresholds for the created agronomic model. Agronomic models may be compared using cross validation techniques including, but not limited to, root mean square error of leave-one-out cross validation (RMSECV), mean absolute error, and mean percentage error. For example, RMSECV can cross validate agronomic models by comparing predicted agronomic property values created by the agronomic model against historical agronomic property values collected and analyzed. In an embodiment, the agronomic dataset evaluation logic is used as a feedback loop where agronomic datasets that do not meet configured quality thresholds are used during future data subset selection steps (block 310).

At block 320, the agricultural intelligence computer system 130 is configured or programmed to implement agronomic model creation based upon the cross validated agronomic datasets. In an embodiment, agronomic model creation may implement multivariate regression techniques to create preconfigured agronomic data models.

At block 325, the agricultural intelligence computer system 130 is configured or programmed to store the preconfigured agronomic data models for future field data evaluation.

2.5 Data Assimilation Subsystem

In an embodiment, the agricultural intelligence computer system 130, among other components, includes a data assimilation subsystem 170. The data assimilation subsystem 170 is configured to generate an assimilated crop data model comprising both existing hybrid seed growth stage data and observed hybrid seed growth stage data from one or more observed crop fields. The assimilated crop data model incorporates actual growth stage observations of a specific hybrid seed from a specific field into the model that includes historical observations from multiple fields and multiple hybrid seeds.

In an embodiment, the existing historical crop data model is a crop model used to determine baseline crop growth thresholds based upon historical hybrid seed data and historical weather and soil data from multiple measured fields. The data assimilation subsystem 170 inputs the existing crop data model and observed crop stage data from one or more fields to generate the data assimilation model. The data assimilation model may then be used to estimate enhanced plant growth stage thresholds that are specifically tailored to incorporate the observation data into the plant growth stage threshold values. The data assimilation subsystem 170 uses observation data received from field data 106 and external data 110 and existing digital crop models stored in the model data and field data repository 160.

The growth stage threshold transformation instructions 172 provide instructions to transform growth stage threshold data into growth stage duration values that may then be statistically modeled using a multivariate distribution. In an embodiment, growth stage threshold transformation instructions 172 transforms and generates datasets of growth stage duration values for multiple hybrid seeds. The growth stage estimation instructions 174 provide instructions to generate a multivariate distribution of growth stage durations for multiple hybrid seeds that may be used to generate a posterior distribution of growth stages for the desired hybrid seed at a particular location. In generating the multivariate distribution of growth stage durations, the correlation parameter generation instructions 176 provide instruction to generate correlation parameters that describe correlations between different growth stages for hybrid seeds. The correlation parameters are used by the growth stage estimation instructions 174 to generate the posterior distribution of growth stages for the desired hybrid seed. The threshold calculation instructions 178 provide instructions to generate threshold values that define the estimated crop growth stages based upon the posterior distribution of growth stages.

2.6 Implementation Example-Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

For example, FIG. 4 is a block diagram that illustrates a computer system 400 upon which an embodiment of the invention may be implemented. Computer system 400 includes a bus 402 or other communication mechanism for communicating information, and a hardware processor 404 coupled with bus 402 for processing information. Hardware processor 404 may be, for example, a general purpose microprocessor.

Computer system 400 also includes a main memory 406, such as a random access memory (RAM) or other dynamic storage device, coupled to bus 402 for storing information and instructions to be executed by processor 404. Main memory 406 also may be used for storing temporary variables or other intermediate information during execution of instructions to be executed by processor 404. Such instructions, when stored in non-transitory storage media accessible to processor 404, render computer system 400 into a special-purpose machine that is customized to perform the operations specified in the instructions.

Computer system 400 further includes a read only memory (ROM) 408 or other static storage device coupled to bus 402 for storing static information and instructions for processor 404. A storage device 410, such as a magnetic disk, optical disk, or solid-state drive is provided and coupled to bus 402 for storing information and instructions.

Computer system 400 may be coupled via bus 402 to a display 412, such as a cathode ray tube (CRT), for displaying information to a computer user. An input device 414, including alphanumeric and other keys, is coupled to bus 402 for communicating information and command selections to processor 404. Another type of user input device is cursor control 416, such as a mouse, a trackball, or cursor direction keys for communicating direction information and command selections to processor 404 and for controlling cursor movement on display 412. This input device typically has two degrees of freedom in two axes, a first axis (e.g., x) and a second axis (e.g., y), that allows the device to specify positions in a plane.

Computer system 400 may implement the techniques described herein using customized hard-wired logic, one or more ASICs or FPGAs, firmware and/or program logic which in combination with the computer system causes or programs computer system 400 to be a special-purpose machine. According to one embodiment, the techniques herein are performed by computer system 400 in response to processor 404 executing one or more sequences of one or more instructions contained in main memory 406. Such instructions may be read into main memory 406 from another storage medium, such as storage device 410. Execution of the sequences of instructions contained in main memory 406 causes processor 404 to perform the process steps described herein. In alternative embodiments, hard-wired circuitry may be used in place of or in combination with software instructions.

The term "storage media" as used herein refers to any non-transitory media that store data and/or instructions that cause a machine to operate in a specific fashion. Such storage media may comprise non-volatile media and/or volatile media. Non-volatile media includes, for example, optical disks, magnetic disks, or solid-state drives, such as storage device 410. Volatile media includes dynamic memory, such as main memory 406. Common forms of storage media include, for example, a floppy disk, a flexible disk, hard disk, solid-state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 402. Transmission media can also take the form of acoustic or light waves, such as those generated during radio-wave and infra-red data communications.

Various forms of media may be involved in carrying one or more sequences of one or more instructions to processor 404 for execution. For example, the instructions may initially be carried on a magnetic disk or solid-state drive of a remote computer. The remote computer can load the instructions into its dynamic memory and send the instructions over a telephone line using a modem. A modem local to computer system 400 can receive the data on the telephone line and use an infra-red transmitter to convert the data to an infra-red signal. An infra-red detector can receive the data carried in the infra-red signal and appropriate circuitry can place the data on bus 402. Bus 402 carries the data to main memory 406, from which processor 404 retrieves and executes the instructions. The instructions received by main memory 406 may optionally be stored on storage device 410 either before or after execution by processor 404.

Computer system 400 also includes a communication interface 418 coupled to bus 402. Communication interface 418 provides a two-way data communication coupling to a network link 420 that is connected to a local network 422. For example, communication interface 418 may be an integrated services digital network (ISDN) card, cable modem, satellite modem, or a modem to provide a data communication connection to a corresponding type of telephone line. As another example, communication interface 418 may be a local area network (LAN) card to provide a data communication connection to a compatible LAN. Wireless links may also be implemented. In any such implementation, communication interface 418 sends and receives electrical, electromagnetic or optical signals that carry digital data streams representing various types of information.

Network link 420 typically provides data communication through one or more networks to other data devices. For example, network link 420 may provide a connection through local network 422 to a host computer 424 or to data equipment operated by an Internet Service Provider (ISP) 426. ISP 426 in turn provides data communication services through the world wide packet data communication network now commonly referred to as the "Internet" 428. Local network 422 and Internet 428 both use electrical, electromagnetic or optical signals that carry digital data streams. The signals through the various networks and the signals on network link 420 and through communication interface 418, which carry the digital data to and from computer system 400, are example forms of transmission media.

Computer system 400 can send messages and receive data, including program code, through the network(s), network link 420 and communication interface 418. In the Internet example, a server 430 might transmit a requested code for an application program through Internet 428, ISP 426, local network 422 and communication interface 418.

The received code may be executed by processor 404 as it is received, and/or stored in storage device 410, or other non-volatile storage for later execution.

3. Functional Overview—Generating Assimilated Crop Data Model

Figure 7:
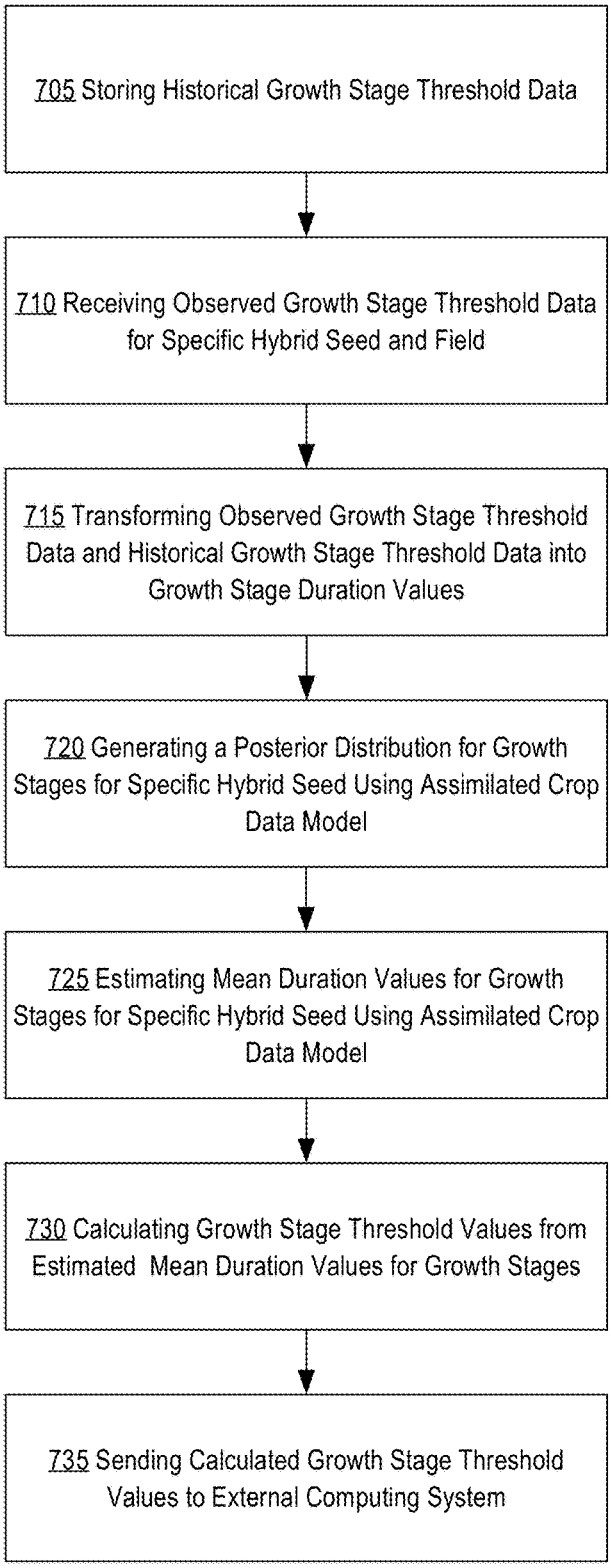
FIG. 7 depicts an example method of generating a set of growth stage thresholds using an assimilated crop data model that incorporates historical growth stage data and observed growth stage data from fields.

FIG. 7 depicts a detailed example of generating a set of growth stage thresholds using an assimilated crop data model that incorporates historical growth stage data and observed growth stage data from particular agricultural fields.

3.1. Data Input

The agricultural intelligence computer system 130 may receive historical agricultural data and observed growth stage data from various external sources. In an embodiment, the agricultural intelligence computer system 130 may receive historical crop growth data in the form of a historical crop growth data model from an external crop growth data modeling system. External crop growth data modeling systems may include both public and private modeling computer programs that determine crop growth stages using either publicly available agricultural data or privately held agricultural data.

In an embodiment, observational data may include, but is not limited to, publicly available observation data related to a specific hybrid seed and a specific field or directly observed crop growth data from farmers who input their observations into the field manager computing device 104.

3.1.1. Storing Historical Data Model

At step 705, a historical crop growth model is stored in the model data and field data repository 160. In an embodiment, the historical crop growth model may represent a crop growth model for hybrid seeds that calculates time thresholds for specific growth stages that describe crop phenology for a plant species.

Crop phenology is the study of the life cycle of a plant species from planting to harvest. In an embodiment, the crop phenology may be divided into different stages, each identifying a particular period in the plant's growth. Growth stages may be divided into two major types of stages, vegetative and reproductive stages. Vegetative growth stages are the stages where the corn plant develops from a seed to a fully formed plant. The reproductive stages describe stages starting from when pollen may be produced to the corn plant's physical maturity. The phenology stages of the corn plant may be tracked based upon factors outside the appearance of the individual corn plants. For example, the phenological development of corn plants is strongly related to the accumulation of heat by the plants, which furthers plant growth. The accumulation of heat may be estimated by tracking daily maximum and minimum temperatures in or near the field. In an embodiment, growing degree days (GDD) are used to track the different developmental stages of corn plant growth and are calculated from the maximum and minimum daily air temperatures. A particular growth stage is reached when the accumulated growing degree days (AGDD) crosses a specified threshold for that stage. Further details on crop phenological stages and AGDDs are discussed in detail in the section herein titled 5.0. CROP PHENOLOGY.

In an embodiment, the historical crop growth model is a digital data model that is programmed or configured to calculate crop phenology thresholds for specific hybrid seeds. Output of the historical crop growth model may be based on multiple input factors including, but not limited to, crop environment such as daily temperature observations, crop management such as planting date, and crop characteristics such as specific hybrid seed type and relative maturity. Other factors may include, remotely sensed soil and weather data for crop environment input and seed and row planting width for crop management.

In an embodiment, storing the historical crop growth model may include initially creating the historical crop growth model. For example, if the historical crop growth model is stored in the model data and field data repository 160 then the model data and field data repository 160 would include input data for generating the historical crop growth model, configured parameters used for generating the historical crop growth model, and the output crop phenology thresholds for specific hybrid seeds. By storing the entire historical crop growth model, different output variations may be generated by the agricultural intelligence computer system 130 by altering the modeling parameters.

In another embodiment, storing the historical crop growth model may include only storing the output crop phenology thresholds generated by the historical crop growth model. For example, the agricultural intelligence computer system 130 may receive input factors for generating an instance of the historical crop growth model, and then use the generated historical crop growth model to estimate crop growth stage thresholds for desired hybrid seeds and then store the crop growth thresholds in the model data and field data repository 160. For example, crop growth stage threshold output stored in the model data and field data repository 160 may be formatted and stored as:

| Growth Stage | AGDD (° C.) at RM 112 |
|---|---|
| V2 | 110 |
| V4 | 190 |
| V6 | 258 |
| V8 | 341 |
| V10 | 410.5 |
| V12 | 480.1 |
| V14 | 552.5 |
| V16 | 627.1 |
| R1 | 773.5 |
| R2 | 917.1 |
| R3 | 1063.5 |
| R4 | 1209.9 |
| R5 | 1350 |
| R5.5 | 1430 |
| R6 | 1492 |

where each growth stage threshold observed for a specific hybrid seed is represented as an AGDD value.

3.1.2. Receiving Observation Data

At step 710, one or more observed growth stage values are received. In an embodiment, observed growth stage values may be observed growth stage thresholds that represent ground-based phenology observations of the starting and/or ending of growth stages from crop fields. In an embodiment, observed growth stage thresholds may be received as field data 106 directly from a user 102 who observes one or more different crop growth stages and records the observations on the field manager computing device 104. The field manager computing device 104 then transforms the observations into one or more digital measurement values and transmits the digital measurement values as field data 106 to the agricultural intelligence computer system 130.

In another embodiment, the observed growth stage thresholds may be received as external data 110 from the data server computer 108. The data server computer 108 may represent one or more public or private data servers that compile observed growth stage threshold data from many different farmers in various locations over time. For example, observed growth stage threshold data may include aggregated observation data over several years from research fields located in corn growing states. The data server computer 108 may represent an external data server that compiles public field observations information over several years.

The one or more observed growth stage thresholds received may be compiled as a dataset of growth stage thresholds measured in GDDs for a specific field and specific hybrid seed. The observed growth stage thresholds may represent an entire set of observed growth stages or a partial set of growth stages. For example, user 102 may observe growth stages V2, V4, V6, and V8 of his planted hybrid seed and may transmit the four growth stages to the agricultural intelligence computer system 130 via the field manager computing device 104. The partial set of growth stages may be formatted as:

| Growth Stage | GDD (° C.) at RM 112 |
|---|---|
| V2 | 110 |
| V4 | 190 |
| V6 | 258 |
| V8 | 341 |

where each growth stage threshold observed is represented as a GDD value.

In another embodiment, observed growth stage thresholds received may include observation data received as values other than GDDs. For example, manually inputted growth stage thresholds by the user may only include the date of planting and the date of an observed growth stage. In this scenario, the agricultural intelligence computer system 130 may be configured to derive the GDD values for the observed growth stage thresholds by also receiving temperature data, as additional external data 110 received, for the days between planting the hybrid seed and the observation dates.

3.2. Assimilated Crop Data Model

Data assimilation is the process by which observations of an actual system are incorporated into the model state of a data model of that particular system. In this context, actual observations of the beginning and ending of particular growth stages are incorporated into an existing crop growth threshold model in order to account for different types of variability that may be reflected in the actual observations of crop growth thresholds.

In an embodiment, the assimilated crop data model may be generating by applying Bayes' Theorem to determine the level of inference of uncertain parameters in the model. Bayes' Theorem is an approach for determining the conditional probability of an outcome by revising existing predictions given new and/or additional evidence. An example of mathematically describing Bayes' Theorem is as follows:

$$P(A \mid B) = \frac{P(B \mid A)P(A)}{P(B)}$$

where P(A|B) is the probability of observing event A given that event B is true; P(B|A) is the probability of observing event B given that A is true; P(A) and P(B) are the probabilities of observing A and B independent of each other.

The assimilated crop data model may be modeled using Bayes' Theorem, where the assimilated crop data model determines a probability distribution of the growth stage thresholds for a hybrid seed given historical growth stage information and given actual observations of growth stages. In an embodiment, the assimilated crop data model may use the historical crop growth model stored within the model data and field data repository 160 as the model for determining growth stage thresholds and use the one or more observed growth stage thresholds received at 710, as an observed event that influences the estimated probability of the growth stage thresholds for the specific hybrid seed. The estimated probability of the growth stage thresholds may be determined as a posterior distribution of θ such that:

$$p(\theta|y) \propto p(y|\theta) \times p(\theta)$$

where p(θ|y) is the probability density function of y given θ, and p(θ) is a prior distribution of θ, representing our uncertainty about θ before injecting observed y.

3.2.1. Transforming Growth Stage Threshold Data

In an embodiment, in order to estimate probability distributions, using the assimilated crop data model, the assimilated crop data model input needs is formatted such that the input conforms to assumptions needed to generate prior distributions. In an embodiment, prior distributions are based on normally distributed datasets of values including continuous values that may include both negative and positive values.

In an embodiment the historical crop growth model includes data sets of growth stage thresholds that represent GDDs for given hybrid seeds relative to the planting date. For example the growth stage threshold for stage V2 may be represented as 101.0 and the growth stage threshold for stage V4 may be represented as 190.5 where each value is a montonically increasing GDD value that is relative to the planting date. In order to generate normally distributed datasets for each growth stage for a hybrid seed, the growth stage thresholds need to be transformed into duration values that represent the duration of each growth stage.

At step 715, the growth stage threshold transformation instructions 172, provide instruction to transform growth stage thresholds of hybrid seeds into growth stage duration values that represent a duration of a particular growth stage in GDDs. In an embodiment transformation of growth stage thresholds into growth stage duration values may include the transformation of thresholds from historical growth stage data, from the historical growth stage model stored at step 705, and observed growth stage thresholds received at step 710. A particular growth stage threshold value may represent the end boundary of the particular growth stage. The duration of the particular growth stage may be determined as the difference between the end boundary of the particular growth stage and a beginning boundary for that particular growth stage. The beginning boundary for the particular growth stage may be determined as the end boundary of the preceding growth stage. For example, the historical growth stage threshold data for a particular hybrid seed may include growth stage thresholds where V2=101.0 and V4=190.5. If the growth stage duration for the V4 stage is desired, then the growth stage duration may be calculated as the difference of the V4 growth stage threshold, 190.5, and the growth stage threshold of the preceding growth stage, in this case V2 which equals 101.0. Therefore the duration, $D_4$, would equal 190.5-101.0, which is 88.5 GDDs.

Figure 9:
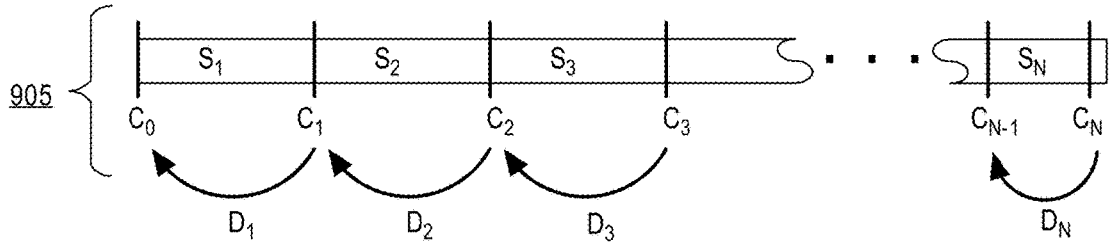
FIG. 9 depicts an example of multiple growth stages, growth stage durations, and growth stage thresholds of a sample hybrid seed.

FIG. 9 depicts an example of multiple growth stages of a hybrid seed. Growth timeline 905 depicts a growth timeline for the multiple growth stage thresholds, $C_0$-$C_N$. In an embodiment, the multiple growth stage threshold values $C_0$-$C_N$, represent the growth stage thresholds for a hybrid seed. Stages $S_1$-$S_N$, represent growth stages from planting ($V_0$) through black layer ($R_6$) within the growth timeline 905. In an embodiment, durations for each of the stages $S_1$-$S_N$, may be calculated using the growth stage thresholds $C_0$-$C_N$, as boundaries for the stages. Growth stage durations $D_1$-$D_N$ represent duration values for stages $S_1$-$S_N$, such that:

$$D_i=C_i-C_{i-1}$$

where $D_i$ equals the duration value for stage $S_i$.

In an embodiment, calculated growth stage durations are further transformed by performing a log transformation on the growth stage duration values. Log transformations of data within datasets are used to show correlations between data within the dataset that would normally not be visible. Additionally, log transformations may stabilize the amount of variance within a dataset and may be used to transform a set of count variables into a set of continuous variables. Count variables are defined as data in which the observations can only be non-negative integer values. In this context, the growth stage duration values in GDD are count variables since the duration of a particular stage cannot be negative. Continuous variables are defined as variables that may have an infinite number of possible values. Based on the flexible nature of continuous variable values, continuous variables are preferred when performing statistical analysis on datasets.

In an embodiment, the log difference transformation of the growth stage durations may be calculated as:

$$H_i=\log(D_i)$$

where $H_i$ represents the log difference growth stage of growth stage duration $D_i$.

In an embodiment, the transformation of growth stage thresholds into growth stage duration values is performed on the growth stage observations received at step 710 to produce an aggregated dataset of observed log-difference values.

In an embodiment, the historical growth stage thresholds stored at step 705 are also transformed using programmed instructions from growth stage thresholds into growth stage duration values, represented as an aggregated dataset of historical log-difference values.

3.2.2. Generating Assimilated Crop Data Model

In an embodiment, the dataset of observed growth stage duration values may be assimilated into the aggregated dataset of historical growth stage duration values to produce a multivariate normal distribution model, which represents the assimilated crop data model. A multivariate normal distribution is an n-dimensional normal distribution that models the distribution for an n-dimension vector of values. For instance, an n-dimensional vector may be a vector of observed log-difference values for growth stages for a particular hybrid seed at a particular field. The n-dimensional normal distribution may be represented as:

$$H|\theta\sim N_n(\theta,\Sigma)$$

where θ is a vector of log difference durations of unknown growth stages, Σ is an error matrix that represents measurement errors, and $N_n$ (θ,Σ) is a normal distribution for a particular growth stage n within vector θ, where θ is the mean and Σ is the variance. The assimilated crop data model may then be used to generate a posterior distribution that estimates the mean and variance of growth stage thresholds for a particular hybrid seed.

In order to generate a posterior distribution from the assimilated crop data model the observed growth stage duration values and the historical growth stage duration values must first be modeled statistically. In an embodiment, the historical growth stage duration values may be modeled statistically to produce a posterior distribution of vector θ:

$$\theta\sim N_n(M,S)$$

where:

M represents a dataset of the historical growth stage duration values transformed into log difference values.

S is a covariate matrix that represents the natural variability for a specific hybrid seed or a specific field and correlations between growth stages for the specific hybrid seed from dataset M. Natural variability is variability based upon natural factors that affect the climate around specific hybrid seed data or fields.

In an embodiment, parameters within the covariate matrix, S, and error matrix, Σ are determined using the dataset of the historical growth stage duration values as described in the posterior distribution of vector θ. In an embodiment, parameter values for the covariate matrix, S, and error matrix, Σ may be a standardized matrix of values that covers several hybrid seeds and fields represented by the dataset M. In another embodiment, the matrices S and Σ may be specific to the hybrid seed type. In this scenario, matrices S and Σ may be based upon data that is specific to the natural variability of the specific hybrid seed or the field where the hybrid seed was planted. In yet another embodiment, matrices S and Σ may be customized based upon a geographic region that covers a set of fields in a particular area. For example, a specific covariate matrix S may be used for estimations related to fields within a specific county or state, while another covariate matrix S may be used for a different country or state.

In an embodiment, parameters within matrices S and Σ may show correlations between durations of multiple growth stages. Configuring the parameters within S and Σ are discussed in detail in the section herein titled CONFIGURING CORRELATION PARAMETERS.

In an embodiment, the posterior distribution for a particular hybrid seed based on the assimilated crop data model may be represented as:

$$H=\theta+\in,\text{ where }\in\sim N_n(0,\Sigma),$$

$$\theta=M+v,\text{ where }v\sim N_n(0,S)$$

where:

H represents the specific hybrid seed observed from growth stage threshold data.

θ represents the posterior distribution generated from the assimilated crop data model as a multivariate normal distribution.

∈ and v each represent error components that are normal distributions with variances based upon Σ and S respectively.

Referring back to FIG. 7, at step 720 the growth stage estimation instructions 174 provide instruction to generate a posterior distribution that represents for the growth stages for the hybrid seed using the assimilated crop data model. The posterior distribution is then used to determine the mean and covariance for growth stage durations for a specific hybrid seed.

3.2.2.1 Using a Complete Set of Observed Growth Stages

In an embodiment, if the observed growth stage durations contain growth stage duration values for each growth stage of the hybrid seed, then the posterior distribution calculated from the assimilated crop data model is a normal distribution. The mean and variance for normal posterior distribution of θ, given observed growth stage durations H, may be calculated as:

$$\mathbb{E}(\theta,H)=(\Sigma^{-1}+S^{-1})^{-1}(\Sigma^{-1}H+S^{-1}M)$$

$$\mathbb{C}\text{ov}(\theta,H)=(\Sigma^{-1}+S^{-1})^{-1}$$

where:

$\mathbb{E}(\theta, H)$ is the expected mean for the observed hybrid seed represented in vector form containing expected mean growth stage duration values based on the assimilated crop data model.

$\mathbb{C}ov(\theta, H)$ is the variance for the observed hybrid seed represented in vector form containing expected mean growth stage duration values based on the assimilated crop data model.

$\Sigma^{-1}$ is the transpose of the error matrix E.

$S^{-1}$ is the transpose of the covariance matrix S.

Referring to FIG. 7, at step 725 the growth stage estimation instructions 174 provide instructions to the estimated mean and variance values for each growth stage. In an embodiment, the estimated mean and variance values for each growth stage may be aggregated into an estimated log difference dataset for the particular hybrid seed.

3.2.2.2 Using an Incomplete Set of Observed Growth Stages

In another embodiment, if the observed growth stage durations calculated from the received growth stage thresholds from step 710 contain only an incomplete set of the growth stage duration values for the hybrid seed, where an incomplete set means that at least one growth stage does not contain a duration value, then the assimilated crop data model may be generated based using a joint probability distribution. The posterior distribution is then be calculated from the joint probability distribution model that is based upon modeling θ and sub-vector H*, where H* is a sub-vector containing duration values for the observations received at step 710. If H is an (n×1) vector of durations values for all growth stages for the hybrid seen, then H* is a (r×1) vector of duration values, where r≤n.

In an embodiment, in order to use sub-vector H* in the joint probability distribution model, an incidence matrix is be used to describe the relationship between the observed growth stage duration values available. An incidence matrix is a matrix that shows a relationship between two classes of objects. The incidence matrix is an (n×n) matrix composed of zeros and ones. The off diagonal elements of the incidence matrix are set to zero. Diagonal elements of the incidence matrix have values set to one only if the corresponding stage duration for the diagonal element has an associated observation. Diagonal elements corresponding to unobserved stage durations have values set to zero. For example, if growth stage observations only exist for the second stage duration and the fifth stage duration, then incidence matrix would contain zero values for all diagonal elements except for elements at position (2, 2) and (5, 5), which would contain values equal to one.

Using an incidence matrix, sub-vector H* may be used to determine mean and variance values for the remaining unobserved growth stage duration values that make up vector H such that the assimilated crop data model may be represented as:

$$H^* = F\theta + F\in, \text{ where } \in \sim N_n(0, \Sigma),$$

$$\theta = M + v, \text{ where } v \sim N_n(0, S)$$

where F is the incidence matrix.

In an embodiment, the joint probability distribution model may be represented as:

$$\begin{pmatrix} H^* \\ \theta \end{pmatrix} \sim N_{r+n}\left(\begin{pmatrix} E(H^*) \\ E(\theta) \end{pmatrix}, \begin{pmatrix} \mathrm{Cov}(H^*) & \mathrm{Cov}(H^*, \theta) \\ \mathrm{Cov}(\theta, H^*) & \mathrm{Cov}(\theta) \end{pmatrix}\right)$$

where:

E(θ) is the expectation of θ. where E(θ)=M.

E(H*) is the expectation of sub-vector H*. where E(H*)=FM.

Cov(θ) is the covariance of θ. where Cov(θ)=S.

Cov(H*) is the covariance of H*. where Cov(H*)=0+FSF'+FΣF'=F(S+Σ)F'.

Cov(H*, θ) is the cross-covariance of H* and θ. where Cov(H*, θ)=FS.

Cov(θ, H*) is the transpose of the cross-covariance Cov(H*, θ). where Cov(θ, H*)=SF'.

In an embodiment, the mean and variance for normal posterior distribution of θ, given the observed growth stage durations in H*, may be calculated as:

$$\mathbb{E}(\theta, H^*) = E(\theta) + \mathrm{Cov}(\theta, H^*)[\mathrm{Cov}(H^*)]^{-1}(H^* - E(H^*))$$

$$\mathbb{E}ov(\theta, H^*) = \mathrm{Cov}(\theta) - \mathrm{Cov}(\theta, H^*)[\mathrm{Cov}(H^*)]^{-1}\mathrm{Cov}(H^*, \theta)$$

where:

E(θ)=M

E(H*)=FM

Cov(θ)=S

Cov(H*)=0+FSF'+FΣF'=F(S+Σ)F'

Cov(H*, θ)=FS

Cov(θ,H*)=SF'

Step 725 may also represent the step for estimating the mean and variance values for each growth stage using the joint probability distribution model described. In an embodiment, the estimated mean and variance values for each growth stage may be aggregated into an estimated log difference dataset for the hybrid seed.

3.3. Calculating Thresholds for Target Field

At step 730, the threshold calculation instructions 178 provide instruction to calculate threshold values from the mean values in the estimated log difference dataset generated at step 725. In an embodiment, the mean values generated are log-difference values of estimated durations for each of the growth stages for the hybrid seed. To determine the growth stage thresholds from the log-difference values, an exponent function is calculated, for each of the growth stages using the log-difference values. The base value for the exponent function is 10, corresponding to the log-base used to generate the observed and historical log-difference duration values at step 715. For each specific growth stage, the exponential in the exponent function is the mean value from the estimated log-difference dataset corresponding to that specific growth stage. Taking the exponential of the log-difference value yields estimated growth stage duration values for each of the growth stages for the hybrid seed. In an embodiment, a variance associated with each growth stage may also be calculated by taking the exponential of the variance from the estimated log difference dataset using a 10-base and the variance value as the exponent.

In an embodiment each of the growth stage duration values may be aggregated into an estimated growth stage duration dataset where the first element corresponds to the estimated growth stage duration value of the first growth stage and subsequent elements each correspond to subsequent growth stages. In another embodiment, the estimated growth stage duration dataset may also include calculated variance values for each growth stage. Referring back to the multiple growth stages example from FIG. 9, growth timeline 905 depicts the growth timeline for the hybrid seed, including multiple growth stages $S_1$-$S_N$ and growth stage duration values $D_1$-$D_N$ for each of the multiple growth stages. The estimated growth stage duration dataset contains values for each of the growth stage durations $D_1$-$D_N$.

The multiple growth stage threshold values $C_0$-$C_N$, from the growth timeline for the hybrid seed may be calculated using the growth stage duration values $D_1$-$D_N$, from the estimated growth stage duration dataset. In an embodiment, each growth stage threshold may be calculated as the sum of the corresponding estimated growth stage duration and the preceding growth stage durations. For example, calculations for the multiple growth stage threshold values $C_0$-$C_N$, may be described as:

$C_0=0$, where $C_0$ represents planting $C_1=D_1$, where $C_1$ represents the first growth stage threshold $C_2=D_2+D_1$, where $C_2$ represents the second growth stage threshold $C_3=D_3+D_2+D_1$, where $C_3$ represents the third growth stage threshold $C_{N-1}=D_{N-1}+D_{N-2}+ \ldots +D_1$ $C_N=D_N\ D_{N-1}+ \ldots +D_1$, where $C_N$ represents the last growth stage threshold In an embodiment, the calculated multiple growth stage thresholds may be aggregated to generate a set of crop growth stage threshold values. The variance values associated with each estimated growth stage duration value may also be associated with each growth stage threshold and may be used to describe variability associated with the estimated growth stage threshold values. For example, the variance values may be used to generate a prediction interval that specifies, for a given percentage, a range for a growth stage threshold based upon the calculated growth stage threshold value and the associated variance.

3.4. Communicating the Calculated Growth Stage Thresholds

Referring back to FIG. 7, at step 735 the presentation layer 134 sends the set of crop growth stage threshold values for the hybrid seed to one or more external computer systems for the purposes of updating crop management. In an embodiment, the presentation layer 134 packages and sends the set of crop growth stage threshold values in a format that is displayable on the field manager computing device 104.

In another embodiment, the presentation layer 134 packages and sends the set of crop growth stage threshold values in a format that is compatible with other crop managements systems. An example of one crop management system that may receive and use crop growth stage data is the Nitrogen Advisor system, commercially available from The Climate Corporation. The Nitrogen Advisor system may be used to determine timing of nitrogen deployment into fields pre-planting, during crop growth, and even post-planting. Estimated crop growth stage threshold data may help determine and recommend more accurate times for deploying nitrogen into a field, including the amount of nitrogen that needs to be deployed at a given time. Another example of a crop management system that may receive and use crop growth stage data is a Harvest Advisor system, also from Climate, which is configured to determine the black layer data for a crop and then based on the black layer date determine the optimal date for harvesting the crop. The Harvest Advisor system may use the set of crop growth stage threshold values to adjust a determined black layer date for harvesting purposes. Therefore the set of crop growth stage threshold values may aid in determining optimal harvest times for different crop and at different fields.

Other examples of a crop management system that may receive and use crop growth stage data include agricultural management systems that control watering programs for crops. These agricultural management systems may include, but are not limited to, a centralized computer server that controls multiple watering systems or computer systems directly attached to watering equipment. Adjustment of the timing and the amount of water administered to crop fields is critical to progressing the crop growth stages. For example, different growth stages may require different amounts of water, therefore accurately predicting the growth stage thresholds may improve watering efficiency and accuracy as it applies to different growth stages.

In another embodiment, the set of crop growth stage threshold values for the hybrid seed may be stored within the model data and field data repository 160 for the purposes of improving existing crop growth models. For example, the set of crop growth stage threshold values may be associated with the existing historical crop growth model and stored within model data and field data repository 160 such that the estimated crop growth thresholds are used to improve the accuracy of the historical crop growth model for future crop growth stage estimations.

4.0. Configuring Correlation Parameters

Parameters within the covariate matrix S and the error matrix E may illustrate correlations between the multiple growth stages within the growth lifecycle of the hybrid seed. Specifically, the positions within each matrix define which growth stages correlate with each other. Matrix position (x, y) specifies the correlation between growth stage x and growth stage y, of the hybrid seed where x defines the row location within the matrix and y defines the column location within the matrix. For example, the value at matrix position (3, 4) is the correlation value between growth stage 3 and growth stage 4. Additionally, values along the diagonal, for example at position (3, 3) may be defined as completely correlated, represented with the value 1, since the x and y growth stage is the same.

In an embodiment, the error matrix E may be configured to show that errors in observations of growth stages are conditionally independent so that θ and elements of H are each independently observed. This conditional independence may be represented by using a diagonal matrix separating the vegetative stages from the reproductive stages such that:

$$\Sigma = \Sigma_1 + \Sigma_2 = \gamma_1^2\begin{pmatrix} I_{V's} & 0 \\ 0 & 0 \end{pmatrix} + \gamma_2^2\begin{pmatrix} 0 & 0 \\ 0 & I_{R's} \end{pmatrix}$$

where:

$I_{V's}$ is an identity matrix with dimensions matching the total number of vegetative stages, $I_{R's}$ is an identity matrix with dimensions matching the total number of reproductive stages, $\gamma_1^2$ and $\gamma_2^2$ are parameters used for summing the identity matrices into a single diagonal matrix Σ.

In an embodiment, covariate matrix S may be configured as a non-diagonal matrix of parameters that illustrates correlations between growth stages. A non-diagonal matrix is a matrix that contains non-zero values at positions in the matrix that are not at diagonal positions. In an embodiment, covariate matrix S may be illustrated as:

$$S=\Sigma^2\Lambda$$

where $\tau^2$ represents a variance parameter and Λ is a correlation matrix with dimensions representing the growth stages for hybrid seeds.

In an embodiment, the correlation matrix $\Lambda$ may be separated into multiple sub-matrices each representing the different correlations between different types of growth stages, such as the vegetative stages and the reproductive stages. The correlation matrix $\Lambda$ may include four different sub-matrices:

$$\Lambda = \begin{pmatrix} \Lambda_1 & \Lambda_{12} \\ \Lambda_{21} & \Lambda_2 \end{pmatrix}$$

where $\Lambda_1$ is a correlation matrix that represents correlations between the vegetative stages, $\Lambda_2$ is a correlation matrix that represents correlations between the reproductive stages, $\Lambda_{12}$ is a cross-correlation matrix that represents the cross-correlation between vegetative and reproductive stages, and $\Lambda_{21}$ is the transpose of the $\Lambda_{12}$ such that $\Lambda_{21}=\Lambda'_{12}$.

In an embodiment, the correlations may be represented by the number of non-diagonal entries within each of the sub-matrices. For example, the sub-matrices may be configured such that any given growth stage only influences its neighboring stages. The sub-matrices may show correlations between neighboring stages with non-zero values in positions adjacent to the diagonal positions within the matrix. FIG. 10 depicts example embodiments of parameter matrices showing correlations between neighboring growth stages. Matrix 1005 depicts correlation matrix $\Lambda_1$ which shows correlations between vegetative stages. Within matrix 1005, v_columns (2, 4, 6, . . . , 14) and v_rows (2, 4, 6, . . . , 14) each represent the vegetative stages V2-V14. Correlations between two different stages are represented as (v_column, v_row). For example, the correlation between stages V2 and V4 may be determined as the value at position (v_column=V2, v_row=V4), which is $\lambda_1$. Matrix 1005 shows positions adjacent to the diagonal as having value $\lambda_1$, which represents a configured correlation parameter for vegetative stages that are adjacent to each other.

In an embodiment, matrix 1010 depicts an example correlation matrix for reproductive stages. Similar to matrix 1005, r_columns (R1, R2, . . . , R6) and r_rows (R1, R2, . . . , R6) represent the different reproductive stages. Matrix 1010 depicts adjacent reproductive stages as having a correlation parameter of $\lambda_2$.

In an embodiment, both matrix 1005 and matrix 1010 may be configured to show different correlations between their respective stages. For example, if correlations exist between stages that are two degrees away, then correlation matrices 1005 and 1010 may be configured to contain non-zero parameter values at positions that are two positions away from the diagonal. In yet other embodiments, non-zero parameter values may be configured at any position to represent correlations between different stages.

In an embodiment, cross-correlation may exist between vegetative stages and reproductive stages. For example, the last vegetative stage, V14, may influence the first reproductive stage. Cross-correlation between different types of growth stages may be modeled using the cross-correlation matrix $\Lambda_{12}$. In FIG. 10, matrix 1015 represents an example of the cross-correlation matrix $\Lambda_{12}$ where cross_r_columns (R1-R6) represent the different reproductive stages and cross_v_rows (V2-V14) represent the different vegetative stages. Matrix 1015 shows correlations between the last vegetative stage V14 (bottom row) and each of the reproductive stages R1-R6. In an embodiment, position cross_v_rows (V14), cross_r_columns (R1) represents the correlation between adjacent growth stages V14 and R1. This correlation parameter may be represented as $\lambda_3$, and may be a different parameter value than the previous $\lambda_1$ and $\lambda_2$ since the duration of the vegetative stage may have a different correlation effect on the adjacent reproductive stage as opposed the similar types of stages.

In an embodiment, the duration of all reproductive stages may be influenced by the duration of vegetative stages. For example, the duration of the last vegetative stage V14, may have an effect on each of the reproductive stage durations. The non-adjacent reproductive stages may be affected differently from the adjacent reproductive stage. Matrix 1015 shows a different correlation parameter value $\lambda_4$ to illustrate an overall correlation between the last vegetative stage V14 and all non-adjacent reproductive stages.

Other embodiments, of the cross-correlation matrix may have different non-zero values in other positions to illustrate correlations between different stages. For example, if other vegetative stages show correlations with reproductive stages, then cross_v_rows (V1-V13) may contain non-zero parameter values to reflect these correlations. Similarly, if the non-adjacent reproductive stages showed no correlation to the vegetative stages, then cross_r_columns (R2-R6) may contain zero values to represent independence between the non-adjacent reproductive stages and the vegetative stages.

After determining which growth stages correlate with each other, correlation values for each of the different parameters within the covariance matrix S and the error matrix $\Sigma$ may be determined. In an embodiment, parameter values for each of the defined parameters within the covariance matrix S and the error matrix $\Sigma$ are determined using maximum likelihood estimations based upon the historical growth stage duration values that make up dataset M. Using the embodiments of parameters described above, the maximum likelihood method is used to determine parameters $\tau^2$, $\lambda_1, \lambda_2, \lambda_3, \lambda_4$ for covariance matrix S and parameters $\gamma_1^2, \gamma_2^2$ for error matrix $\Sigma$. Maximum likelihood estimation is a method of estimating parameters of a statistical model given observations, by finding the parameter values that maximize the likelihood of making the observations given the parameters.

In an embodiment, parameters for covariance matrix S and error matrix E are optimized using the Nelder-Mead method. The Nelder-Mead method a numerical method used to find the minimum or maximum of an objective function in a multidimensional space. Using the Nelder-Mead method parameters may be optimized without constraints.

In an alternative embodiment, the Broyden-Fletcher-Goldfarb-Shanno method may be used to optimize parameters for covariance matrix S and error matrix E. The Broyden-Fletcher-Goldfarb-Shanno method is an iterative method for solving non-linear optimization problems. The Broyden-Fletcher-Goldfarb-Shanno method approximates Newton's method, a class of hill-climbing optimization techniques that determine a stationary point of a function, where the Broyden-Fletcher-Goldfarb-Shanno method uses both the first and second derivatives of the function. In this embodiment, the Broyden-Fletcher-Goldfarb-Shanno method uses constraints where the variances are positive, and the correlation values between −1 and 1. Other embodiments of the Broyden-Fletcher-Goldfarb-Shanno method may have different constraint values or no constraints.

In an alternative embodiment to determining parameters for covariance matrix S, correlations between different growth stages may be determined by determining parameters for a sparse matrix. A sparse matrix is a matrix where the majority of correlation parameters are zero, and most non-zero parameter values are located near the diagonal of the matrix. In an embodiment, a precision matrix P may be used to determine correlations between different growth stages, where precision matrix P is a sparse matrix and is the inverse of correlation matrix S. Sparse matrix properties for precision matrix P may include configuring the diagonal and the two adjacent off-diagonals to contain non-zero values. Off-diagonal positions refer to matrix positions that are either directly above or directly below the diagonal positions of precision matrix P.

In an embodiment, parameters may be determined for the precision matrix in a manner as described above, using maximum likelihood approaches or the Nelder-Mead method. After determining parameters for precision matrix P, the inverse of precision matrix P may be calculated to yield a densely populated covariance matrix S. Advantages of determining a densely populated covariance matrix S is that covariance matrix S may account for most correlations and variances between growth stages. By using a sparse precision matrix P the agricultural intelligence computer system 130 is able to model most correlations and variances between growth stages using only limited parameters for precision matrix P.

5.0. Crop Phenology

Figure 8:
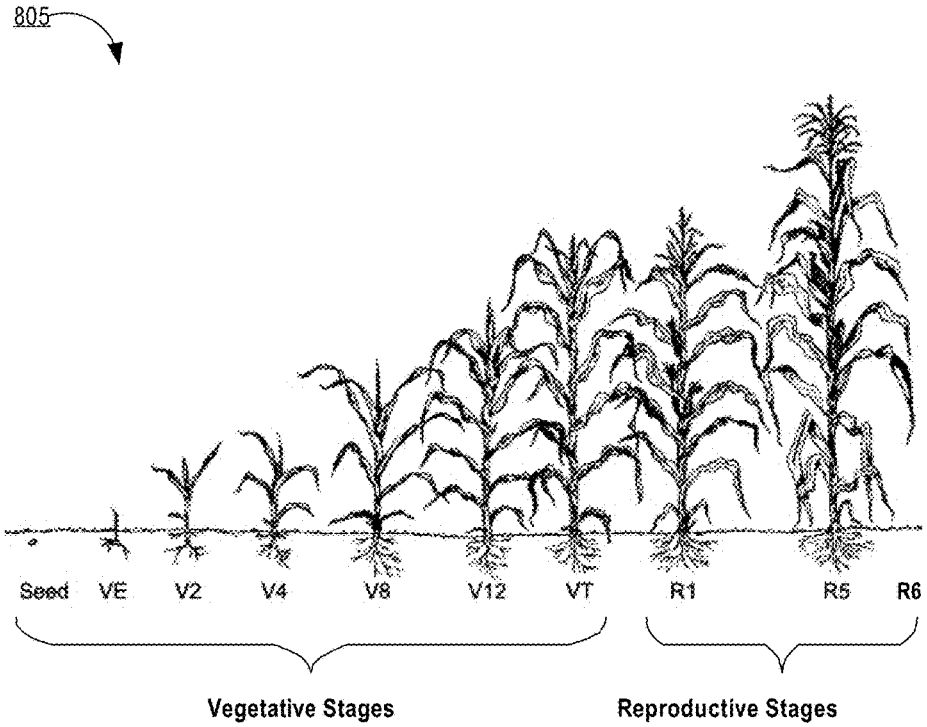
FIG. 8 depicts an example embodiment of corn growth stages and corn growth stage thresholds measured in growing degree days.

The lifecycle of plants is measured using growth development stages starting from seeding to physiological maturity. In corn, the maturity stage is also known as the black layer stage. In FIG. 8, illustration 805 illustrates an example embodiment of corn growth stages. Corn growth stages may be divided into two major types of stages, vegetative and reproductive stages. Vegetative growth stages are the stages where the corn plant develops from a seed to a fully formed plant. The vegetative growth stages are characterized by the crop increasing in biomass, developing roots, stalk, and leaves, and preparing itself for reproduction. Vegetative growth stages begin with the corn emergence stage, labelled as "VE", and end with the fully visible tassel stage, "VT". Corn emergence (VE) signifies the first visible site of the corn plant from the ground. Fully visible tassel (VT) signifies the stage where the tassels, pollen producing flowers, are completely visible. Between the VE and VT stages exist multiple vegetative stages typically denoted by numerals and that describe the growth of the corn plant by how many uppermost leaves are visible with the leaf collar. For example, "V2" signifies the growth stage where two leaves are fully expanded with the leaf collar visible, and "V12" signifies the growth stage where twelve leaves are fully expanded with the leaf collar visible.

The reproductive stages describe stages starting from when pollen may be produced to the corn plant's physical maturity. The reproductive stages begin at silking, "R1," and end at physiological maturity, "R6", also known as the black layer stage. Between stages R1 and R6 are stages relating to the corn plant's growth. For example, "R2" is the blister stage at which kernels are typically white and resemble a blister in shape. Stage "R3" is the milk stage, in which kernels are yellow on the outside with milky inner fluid. Stage "R4" is the dough stage, in which the milky inner fluid thickens to a pasty consistency. Stage "R5" is the dent stage, in which kernels show an external physical dent.

The phenology stages of the corn plant may be tracked based upon factors outside the appearance of the individual corn plants. For example, the phenological development of corn plants is strongly related to the accumulation of heat by the plants, which furthers plant growth. The accumulation of heat may be estimated by tracking daily maximum and minimum temperatures in or near the field. In an embodiment, growing degree days (GDD) are used to track the different developmental stages of corn plant growth. GDD may be calculated using different observational data and different thresholds. For example, GDD may be calculated as:

$$\text{Daily } GDD = \frac{T_{max} + T_{min}}{2} - T_{base}$$

where $$\frac{T_{max} + T_{min}}{2}$$

is the daily average temperature calculated from the daily maximum and minimum temperatures. $T_{base}$ is a lower threshold temperature where no significant corn plant growth occurs. In an embodiment, cutoff values may be set for $T_{max}$ and $T_{min}$. For example, a cutoff value of 86° F. may be set for $T_{max}$ such that $T_{max}$ is set to 86° F. when temperatures exceed 86° F. and a cutoff value of 50° F. may be set for $T_{min}$ such that $T_{min}$ is set to 50° F. when temperatures fall below 50° F.

Therefore when the daily average temperature does not exceed the lower threshold temperature, no growth in the corn plant occurs. Referring back to FIG. 8, chart 810 illustrates an example chart where the number of growing degree days are used to define the start and end of different phenological development stages. For example, after 177 GDDs the V2 stage of the corn plant starts. At GDD 1240, the first reproductive stage, R1, begins. While chart 810 generally illustrates different phenological development stages for a particular crop, in an embodiment different hybrid seed types may enter phenological stages at different times. For example, the cutoff for the V2 stage of a corn plant with a higher relative maturity value than the one depicted in chart 810 may occur after 177 GDDs. Measuring GDDs is particularly useful when determining specific weather indices that correlate to different development stages in corn plant growth.

6. Extensions and Alternatives

In the foregoing specification, embodiments have been described with reference to numerous specific details that may vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction.

What is claimed is:

1. A computer-implemented method comprising:

storing, in digital memory of a computer system, a historical crop growth model of one or more hybrid seeds measured from one or more fields over particular periods of time;

wherein the historical crop growth model comprises a plurality of values and expressions that define transformations of or relationships between the values and produce one or more sets of historic growth stage threshold estimates for the one or more hybrid seeds measured from the one or more fields, wherein the one or more sets of historic growth stage threshold estimates for the one or more hybrid seeds are threshold values that define end boundaries for growth stages for the one or more hybrid seeds;

receiving, at the computer system over one or more networks from a remote computing device, one or more digital measurement values specifying one or more observed growth stage values for a particular hybrid seed at a particular field over a particular period of time, wherein the one or more observed growth stage values describe the growth stage thresholds for one or more growth stages for the particular hybrid seed;

transforming, at the computer system, the one or more sets of historic growth stage threshold estimates into one or more sets of historical growth stage duration values, and the one or more observed growth stage values into one or more observed growth stage duration values, wherein a particular growth stage duration value describes a duration of time for a particular growth stage;

generating, at the computer system, a posterior distribution of growth stage duration values for a particular hybrid seed from a multivariate distribution of growth stage duration value data of one or more hybrid seeds, wherein the multivariate distribution comprises:

the one or more sets of historical growth stage duration values, the one or more observed growth stage duration values, a configured covariate matrix that describes correlations between different growth stages for hybrid seeds, and a configured error matrix that represents variations in the multivariate distribution;

estimating, at the computer system, a set of mean and variance values for growth stages of the particular hybrid seed from the posterior distribution of growth stage duration values for the particular hybrid seed;

calculating and generating, at the computer system, a set of crop growth stage threshold values for the particular hybrid seed based on the set of mean and variance values for the growth stages of the particular hybrid seed, wherein a particular crop growth stage threshold, from the set of crop growth stage threshold values, is calculated by applying an exponential function to values within the set of mean and variance values for the growth stages of the particular hybrid seed and aggregating a subset of mean and variance values for the growth stages that include a growth stage associated with the particular crop growth stage threshold and growth stages that precede the growth stage associated with the particular crop growth stage threshold, wherein the exponential function comprises calculating the exponential value for each mean value, within the set of mean and variance values for the growth stages of the particular hybrid seed, using a ten value as the base value and a particular mean value, from the set of mean and variance values for the growth stages, as the exponent value and calculating the exponential value for each variance value, within the set of mean and variance values for the growth stages of the particular hybrid seed, using a ten value as the base value and a particular variance value, from the set of mean and variance values for the growth stages, as the exponent value;

sending, at the computer system, the set of crop growth stage threshold values for the particular hybrid seed to one or more external computer systems for the purposes of updating crop management instructions.

2. The method of claim 1, wherein transforming the one or more sets of historic growth stage threshold estimates into one or more sets of historical growth stage duration values, and the one or more observed growth stage values into one or more observed growth stage duration values comprises for each growth stage threshold, within the one or more sets of historic growth stage threshold estimates and the one or more observed growth stage values:

determining a growth stage threshold difference value as the difference between a growth stage threshold value and an immediately preceding growth stage threshold value;

determining a log-difference value for the growth stage threshold difference value as the log of the growth stage threshold difference value.

3. The method of claim 1, wherein the multivariate distribution of the growth stage duration data of the one or more hybrid seeds is a multivariate normal distribution.

4. The method of claim 1, wherein generating the posterior distribution of the growth stage durations from the multivariate distribution of the growth stage duration data of the one or more hybrid seeds comprises:

if the one or more observed growth stage duration values is a set of observed growth stage duration values that is a partial set of growth stage duration values for a crop lifecycle, then:

generating a joint probability distribution of growth stage duration values comprising:

the one or more sets of historical growth stage duration values, the one or more observed growth stage values, an incidence matrix used to augment missing growth stage duration values from the one or more observed growth stage values;

a configured covariate matrix that describes correlations between different growth stages for hybrid seeds, and a configured error matrix that represents variations in the joint probability distribution of the growth stage duration values;

generating the posterior distribution of the growth stage durations from the joint probability distribution of the growth stage duration values.

5. The method of claim 1, wherein the configured covariate matrix comprises:

a vegetative-stages correlation covariate sub-matrix that comprises correlation parameters that describe correlations between different vegetative stages for the one or more hybrid seeds;

a reproductive-stages correlation covariate sub-matrix that comprises correlation parameters that describe correlations between different reproductive stages for the one or more hybrid seeds;

a cross-correlation covariate sub-matrix that comprises correlation parameters that describe correlations between vegetative stages and reproductive stages for the one or more hybrid seeds;

a transpose sub-matrix of the cross-correlation matrix;

wherein the configured covariate matrix is divided into quadrants with sub-matrices located at:

the vegetative-stages correlation covariate sub-matrix is located in the top leftmost quadrant;

the cross-correlation covariate sub-matrix is located in the top rightmost quadrant;

the transpose sub-matrix is located in the bottom leftmost quadrant; and the reproductive-stages correlation covariate sub-matrix is located in the bottom rightmost quadrant.

6. The method of claim 5, wherein parameter value positions within the vegetative-stages correlation covariate sub-matrix contain a non-zero vegetative correlation parameter at positions that are adjacent to the diagonal positions within the vegetative-stages correlation covariate sub-matrix;

wherein the non-zero vegetative correlation parameter is a correlation parameter value describing correlations between two different vegetative stages.

7. The method of claim 5, wherein parameter value positions within the reproductive-stages correlation covariate sub-matrix contain a non-zero reproductive correlation parameter at positions that are adjacent to the diagonal positions within the reproductive-stages correlation covariate sub-matrix;

wherein the non-zero reproductive correlation parameter is a correlation parameter value describing correlations between two different reproductive stages.

8. The method of claim 5, wherein at a parameter value position which indicates a correlation between a last vegetative stage and a first reproductive stage within the cross-correlation sub-matrix contains a first cross-correlation parameter that describes the correlation between the last vegetative stage and the first reproductive stage of one or more hybrid seeds;

wherein at parameter value positions which, indicate correlations between the last vegetative stage and reproductive stages other than the first reproductive stage, contain a second cross-correlation parameter that describes correlations between the last vegetative stage and reproductive stages other than the first reproductive stage.

9. The method of claim 5, where the error matrix is populated within non-zero parameters such that different growth stages represented by different positions within the error matrix are independent of other growth stages represented within the error matrix.

10. The method of claim 1, wherein non-zero correlation parameters within the configured covariate matrix are determined using a sparse matrix to determine the location of each of the non-zero correlation parameters.

11. The method of claim 1, wherein the one or more external computer systems comprises at least one of:

an external nutrient application computer system used to monitor and administer nutrients at specific times to one or more crop fields, an external harvesting computer system used to program specific harvest times of crop from the one or more crop fields, an external watering computer system used to monitor and program specific watering times during crop growth within the one or more crop fields.

12. The method of claim 1, further comprising storing, at the computer system, the set of crop growth stage threshold values for the particular hybrid seed, wherein the set of crop growth stage threshold values is associated and stored with the historical crop growth model of one or more hybrid seeds.

13. A computer system comprising:

one or more processors;

one or more non-transitory computer-readable storage media storing instructions which, when executed using the one or more processors, cause the one or more processors to perform:

storing, in digital memory of the computer system, a historical crop growth model of one or more hybrid seeds measured from one or more fields over particular periods of time;

wherein the historical crop growth model comprises a plurality of values and expressions that define transformations of or relationships between the values and produce one or more sets of historic growth stage threshold estimates for the one or more hybrid seeds measured from the one or more fields, wherein the one or more sets of historic growth stage threshold estimates for the one or more hybrid seeds are threshold values that define end boundaries for growth stages for the one or more hybrid seeds;

receiving, at the computer system over one or more networks from a remote computing device, one or more digital measurement values specifying one or more observed growth stage values for a particular hybrid seed at a particular field over a particular period of time, wherein the one or more observed growth stage values describe the growth stage thresholds for one or more growth stages for the particular hybrid seed;

transforming, at the computer system, the one or more sets of historic growth stage threshold estimates into one or more sets of historical growth stage duration values, and the one or more observed growth stage values into one or more observed growth stage duration values, wherein a particular growth stage duration value describes a duration of time for a particular growth stage;

generating, at the computer system, a posterior distribution of growth stage duration values for a particular hybrid seed from a multivariate distribution of growth stage duration value data of one or more hybrid seeds, wherein the multivariate distribution comprises:

the one or more sets of historical growth stage duration values, the one or more observed growth stage duration values, a configured covariate matrix that describes correlations between different growth stages for hybrid seeds, and a configured error matrix that represents variations in the multivariate distribution;

estimating, at the computer system, a set of mean and variance values for growth stages of the particular hybrid seed from the posterior distribution of growth stage duration values for the particular hybrid seed;

calculating and generating, at the computer system, a set of crop growth stage threshold values for the particular hybrid seed based on the set of mean and variance values for the growth stages of the particular hybrid seed, wherein a particular crop growth stage threshold, from the set of crop growth stage threshold values, is calculated by applying an exponential function to values within the set of mean and variance values for the growth stages of the particular hybrid seed and aggregating a subset of mean and variance values for the growth stages that include a growth stage associated with the particular crop growth stage threshold and growth stages that precede the growth stage associated with the particular crop growth stage threshold, wherein the exponential function comprises calculating the exponential value for each mean value, within the set of mean and variance values for the growth stages of the particular hybrid seed, using a ten value as the base value and a particular mean value, from the set of mean and variance values for the growth stages, as the exponent value and calculating the exponential value for each variance value, within the set of mean and variance values for the growth stages of the particular hybrid seed, using a ten value as the base value and a particular variance value, from the set of mean and variance values for the growth stages, as the exponent value;

sending, at the computer system, the set of crop growth stage threshold values for the particular hybrid seed to one or more external computer systems for the purposes of updating crop management instructions.

14. The computer system of claim 13, wherein transforming the one or more sets of historic growth stage threshold estimates into one or more sets of historical growth stage duration values, and the one or more observed growth stage values into one or more observed growth stage duration values comprises for each growth stage threshold within the one or more sets of historic growth stage threshold estimates and the one or more observed growth stage values:

determining a growth stage threshold difference value as the difference between a growth stage threshold value and an immediately preceding growth stage threshold value;

determining a log-difference value for the growth stage threshold difference value as the log of the growth stage threshold difference value.

15. The computer system of claim 13, wherein the multivariate distribution of the growth stage duration data of the one or more hybrid seeds is a multivariate normal distribution.

16. The computer system of claim 13, wherein generating the posterior distribution of the growth stage durations from the multivariate distribution of the growth stage duration data of the one or more hybrid seeds comprises:

if the one or more observed growth stage duration values is a set of observed growth stage duration values that is a partial set of growth stage duration values for a crop lifecycle, then:

generating a joint probability distribution of growth stage duration values comprising:

the one or more sets of historical growth stage duration values, the one or more observed growth stage values, an incidence matrix used to augment missing growth stage duration values from the one or more observed growth stage values;

a configured covariate matrix that describes correlations between different growth stages for hybrid seeds, and a configured error matrix that represents variations in the joint probability distribution of the growth stage duration values;

generating the posterior distribution of the growth stage durations from the joint probability distribution of the growth stage duration values.

17. The computer system of claim 13, wherein the configured covariate matrix comprises:

a vegetative-stages correlation covariate sub-matrix that comprises correlation parameters that describe correlations between different vegetative stages for the one or more hybrid seeds;

a reproductive-stages correlation covariate sub-matrix that comprises correlation parameters that describe correlations between different reproductive stages for the one or more hybrid seeds;

a cross-correlation covariate sub-matrix that comprises correlation parameters that describe correlations between vegetative stages and reproductive stages for the one or more hybrid seeds;

a transpose sub-matrix of the cross-correlation matrix;

wherein the configured covariate matrix is divided into quadrants with sub-matrices located at:

the vegetative-stages correlation covariate sub-matrix is located in the top leftmost quadrant;

the cross-correlation covariate sub-matrix is located in the top rightmost quadrant;

the transpose sub-matrix is located in the bottom leftmost quadrant; and the reproductive-stages correlation covariate sub-matrix is located in the bottom rightmost quadrant.

18. The computer system of claim 17, wherein parameter value positions within the vegetative-stages correlation covariate sub-matrix contain a non-zero vegetative correlation parameter at positions that are adjacent to the diagonal positions within the vegetative-stages correlation covariate sub-matrix;

wherein the non-zero vegetative correlation parameter is a correlation parameter value describing correlations between two different vegetative stages.

19. The computer system of claim 17, wherein parameter value positions within the reproductive-stages correlation covariate sub-matrix contain a non-zero reproductive correlation parameter at positions that are adjacent to the diagonal positions within the reproductive-stages correlation covariate sub-matrix;

wherein the non-zero reproductive correlation parameter is a correlation parameter value describing correlations between two different reproductive stages.

20. The computer system of claim 17, wherein at a parameter value position which indicates a correlation between a last vegetative stage and a first reproductive stage within the cross-correlation sub-matrix contains a first cross-correlation parameter that describes the correlation between the last vegetative stage and the first reproductive stage of one or more hybrid seeds;

wherein at parameter value positions which, indicate correlations between the last vegetative stage and reproductive stages other than the first reproductive stage, contain a second cross-correlation parameter that describes correlations between the last vegetative stage and reproductive stages other than the first reproductive stage.

21. The computer system of claim 17, where the error matrix is populated within non-zero parameters such that different growth stages represented by different positions within the error matrix are independent of other growth stages represented within the error matrix.

22. The computer system of claim 13, wherein non-zero correlation parameters within the configured covariate matrix are determined using a sparse matrix to determine the location of each of the non-zero correlation parameters.

23. The computer system of claim 13, wherein the one or more external computer systems comprises at least one of:

an external nutrient application computer system used to monitor and administer nutrients at specific times to one or more crop fields, an external harvesting computer system used to program specific harvest times of crop from the one or more crop fields, an external watering computer system used to monitor and program specific watering times during crop growth within the one or more crop fields.

24. The computer system of claim 13, wherein the instructions, when executed by the one or more processors, further cause the one or more processors to perform:

storing, in digital memory of the computer system, the set of crop growth stage threshold values for the particular hybrid seed, wherein the set of crop growth stage threshold values is associated and stored with the historical crop growth model of one or more hybrid seeds.

* * * * *